US011603719B2

(12) United States Patent
McCoo et al.

(10) Patent No.: US 11,603,719 B2
(45) Date of Patent: Mar. 14, 2023

(54) UTILITY UMBILICAL SYSTEM

(71) Applicant: NATIONAL OILWELL VARCO, L.P., Houston, TX (US)

(72) Inventors: Marcus Sherwin McCoo, Manvel, TX (US); Oscar Vega, Houston, TX (US); Roy H. McIntyre, Friendswood, TX (US); Alexander Saldana, Houston, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 121 days.

(21) Appl. No.: 17/249,496

(22) Filed: Mar. 3, 2021

(65) Prior Publication Data

US 2021/0277730 A1 Sep. 9, 2021

Related U.S. Application Data

(60) Provisional application No. 62/984,835, filed on Mar. 4, 2020.

(51) Int. Cl.

| | |
|---|---|
| ***E21B 15/00*** | (2006.01) |
| ***E21B 7/02*** | (2006.01) |
| ***E21B 19/15*** | (2006.01) |
| ***E21B 17/00*** | (2006.01) |

(52) U.S. Cl.

CPC ..... *E21B 19/15* (2013.01); *E21B 7/02* (2013.01); *E21B 15/003* (2013.01); *E21B 17/003* (2013.01)

(58) Field of Classification Search

CPC ..... E21B 15/003; E21B 17/07

See application file for complete search history.

(56) References Cited

U.S. PATENT DOCUMENTS

| | | | | |
|---|---|---|---|---|
| 3,318,199 | A * | 5/1967 | Parrett | B66C 13/18 91/462 |
| 4,457,338 | A * | 7/1984 | Moller | E21B 43/26 137/899 |
| 9,353,601 | B2 | 5/2016 | Hause | |
| 9,617,796 | B2 | 4/2017 | Hall et al. | |
| 10,280,693 | B2 | 5/2019 | Ferland et al. | |
| 2013/0077219 | A1 | 3/2013 | Fu et al. | |
| 2014/0090576 | A1 | 4/2014 | Wells, Sr. | |
| 2014/0110538 | A1 | 4/2014 | Wells, Sr. | |
| 2015/0096952 | A1 | 4/2015 | Hall et al. | |
| 2018/0163483 | A1* | 6/2018 | Ferland | E21B 15/003 |
| 2018/0328157 | A1* | 11/2018 | Bishop | E21B 43/26 |

* cited by examiner

*Primary Examiner* — Giovanna Wright

(74) *Attorney, Agent, or Firm* — Schwegman Lundberg & Woessner, P.A.

(57) ABSTRACT

A utility umbilical module may include an expandable frame, a plurality of extendable fluid lines arranged on the expandable frame and configured for fluid coupling between a utility plant and a drill rig, an expandable and retractable electrical system configured for electrically coupling a utility plant to a drill rig, and a ground engaging portion configured for over-the-road transport of the module.

20 Claims, 26 Drawing Sheets

UTILITY UMBILICAL SYSTEM

CROSS-REFERENCE TO RELATED APPLICATION

This patent application claims the benefit of U.S. Provisional Patent Application No. 62/984,835, filed Mar. 4, 2020, which is incorporated by reference herein in its entirety.

TECHNOLOGICAL FIELD

The present disclosure relates to a system and method for managing fluid and electrical lines between a utility plant and a drill rig. More particularly, the present disclosure relates to a system for fluidly and electrically coupling a utility plant to a drill rig while accommodating rig movement relative to the utility plant. Still more particularly, the present disclosure relates to a trailerized utility umbilical system that accommodates the position of a drill rig relative to the utility plant.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Drill rigs are commonly supported by a utility plant that provides power, drill fluid, steam, air, water, and other utilities to the drill rig. The utility plant may be a substantially stationary set of systems that are arranged near a drilling pad having multiple drill sites. The utility plant may have a power generation component, a drill fluid management component, steam and air generations, and other utilities relied on by the drill rig. Supply and return piping, hoses, or other types of fluid lines may be provided for many of the fluid-based utilities, and electrical lines may be provided for the electrically-based utilities. In the case of fluid-based utilities, for example, drill fluid may be supplied by the utility plant and may be returned to the utility plant for cleaning after being used in drilling operations. The drill fluid may be supplied at high pressure and may return to the utility plant at low pressure. In the case of electrical lines, the supply/return (e.g., hot/neutral/ground) lines may be incorporated into bundled electrical lines leading from the utility plant to the rig.

While the utility plant has been said to be substantially stationary, drill rigs commonly move across a grid of drill locations during pad drilling. That is, the drill rig may drill a series of wells in a grid pattern on a drill site. When the rig is finished with one well on the site, movement mechanisms such as skid feet, rail systems, or other movement mechanisms may be used to move the drill rig to a nearby location on a drilling pad. During these relatively short moves of the drill rig, the utility plant may remain stationary and the umbilical system may remain connected between the utility plant and the rig.

Given the above systems, the supply/return piping and electrical lines may need to be extended, pivoted, or otherwise reoriented or adjusted to accommodate the rig position relative to the utility plant position. Devices commonly called suitcases may be used for this task. One or more suitcases may be arranged between the utility plant and the rig. The suitcases may carry fluid and/or electricity to/from the utility plant and rig. The suitcases may be arranged end-to-end in daisy chain fashion depending on how far the suitcase system may be desired to reach. Current suitcase designs suffer from a series of drawbacks. For example, they are large devices that are difficult to maneuver on site, particularly where rough terrain is present. The systems are typically a fixed length lacking adjustability of individual suitcase lengths and relying on overall arrangement of the chain to adjust the length of the system. When drilling operations are complete, the suitcases may be disconnected from one another and lifted onto flat bed trailers for transport. This may require cranes or other heavy lift equipment.

SUMMARY

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

In one or more embodiments, a utility umbilical module may include an extendable frame and a plurality of extendable fluid lines arranged on the extendable frame and configured for fluid coupling between a utility plant and a drill rig. The module may also include an expandable and retractable electrical system configured for electrically coupling a utility plant to a drill rig and a ground engaging portion configured for over-the-road transport of the module.

In one or more other embodiments, a drill rig system may include a utility plant, a mobile drill rig, and a utility umbilical system configured for placing the utility plant and the drill rig in electrical and fluid communication during drilling and throughout movement of the drill rig on a drilling site. The utility umbilical system may include a plurality of utility umbilical modules. Each umbilical module may include an expandable frame and a plurality of extendable fluid lines arranged on the expandable frame and configured for fluid coupling between a utility plant and a drill rig. Each module may also include an expandable and retractable electrical system configured for electrically coupling a utility plant to a drill rig and a ground engaging portion configured for over-the-road transport of the module.

In one or more embodiments, a method of establishing a utility umbilical system may include transporting a utility umbilical module having a ground engaging portion configured for over-the-road transport, by towing the utility umbilical module over the road on the ground engaging portion. The method may also include electrically and fluidly coupling the utility umbilical module to a utility plant and to a drill rig. The method may also include extending the utility umbilical module including extending a frame, piping, and electrical lines on the module.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in one or more embodiments, relates to a utility umbilical system for flexibly, fluidly, and electrically connecting a utility plant to a moveable drill rig. The utility umbilical system may include one or more utility umbilical modules that may be connected end-to-end to create the umbilical system. Each of the modules may allow for internal pivoting as well as pivoting relative to an adjoining module, which provides for a wide range of flexibility of arrangement of modules to reach the drill rig. Each of the modules may also allow for telescopic extension of the module providing for flexibility in the length of any given module and the series of modules. Still further, each module may be adapted for over the road transport, which allows for rapid disconnection from the system and ease of relocation. The utility umbilical system may provide for more efficient set up and disconnection as well as smoother transitioning throughout respective drill locations on a drilling pad.

Figure 1:
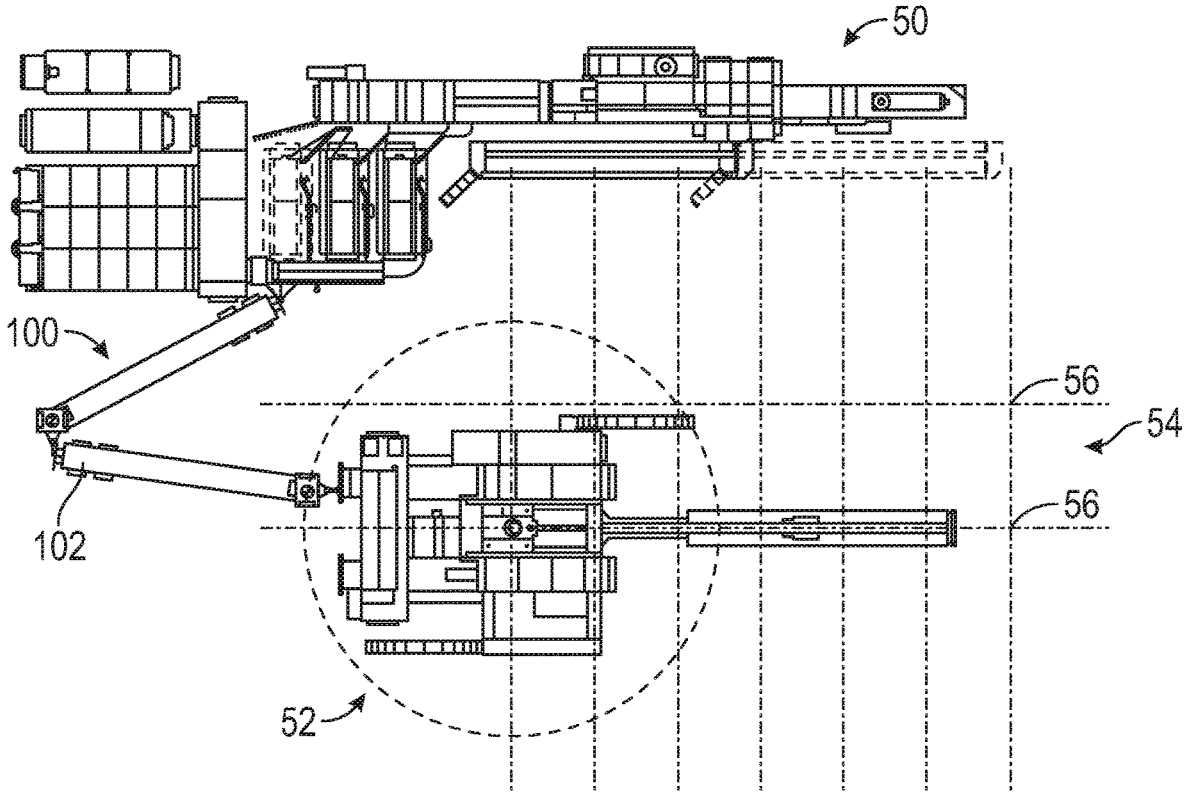
FIG. 1 is a plan view of a utility umbilical systems extending between a utility plant and a drill rig on a drilling pad, according to one or more embodiments.
Figure 2:
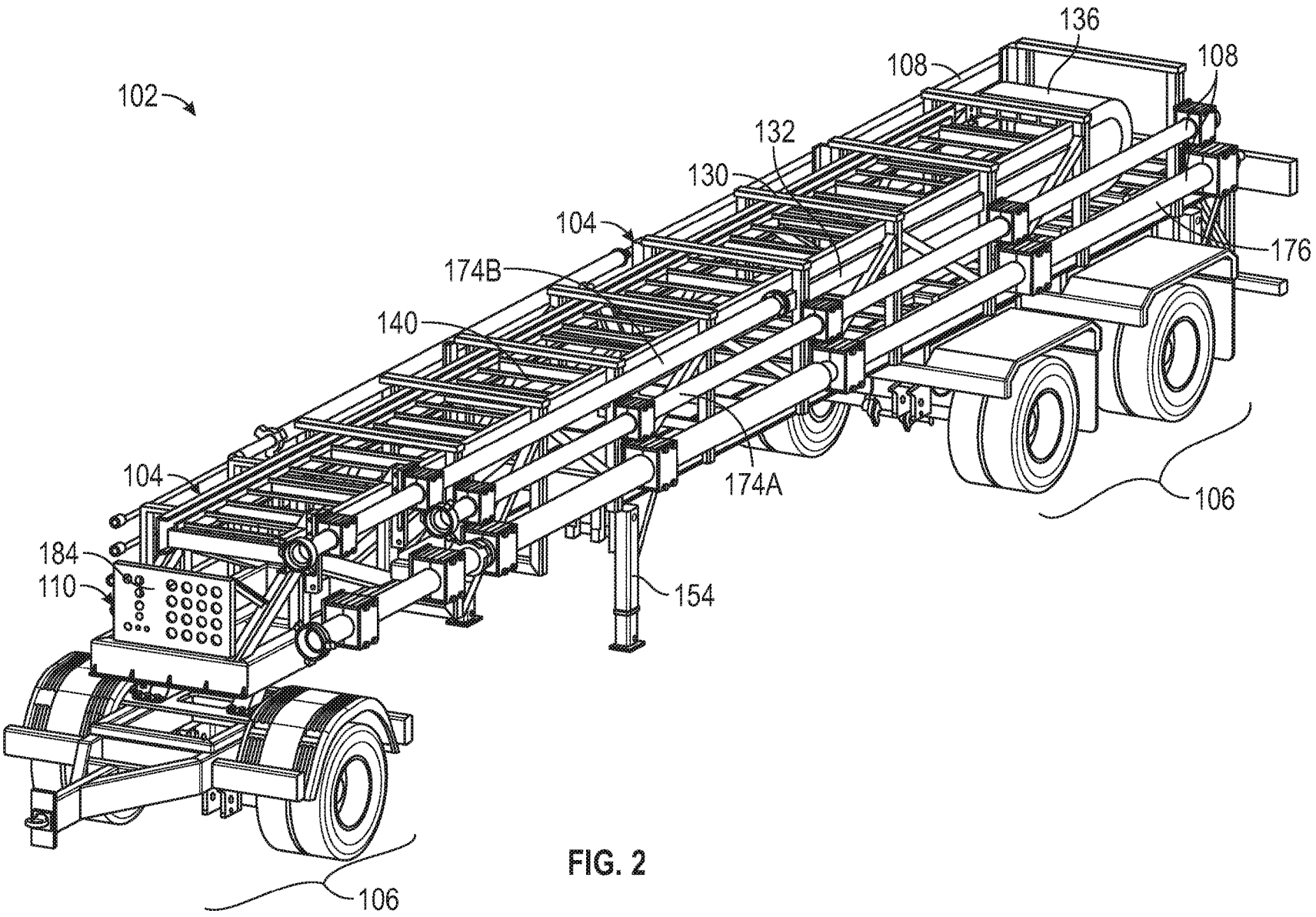
FIG. 2 is a front/left perspective view of a utility umbilical module in a retracted arrangement, according to one or more embodiments.

FIG. 1 is a plan view of a utility umbilical system 100 extending between a utility plant 50 and a drill rig 52 on a drilling pad 54. As shown, the utility plant 50 may include a wide range of utility services for the drill rig. For example, the utility plant may include a drill mud processing system, a power generation system, a steam generation system, and a water supply. Each of these utility services may be in supply/return communication with the drill rig via the utility umbilical system 100. The rig may be arranged at a particular drill location 56 on a drilling pad 54 and may have the ability to move from one location to another as shown and described in more detail with respect to FIGS. 20-32. As the rig moves through the plurality of drill locations 56 on a drill pad 54, the utility umbilical system 100 may maintain the fluid and/or electrical communication of the drill rig 52 with the utility plant 50 so as to avoid interrupted service and to maintain continuity of service during movement and upon arriving at a new drilling location. As shown, the utility umbilical system 100 may include a plurality of modules 102 flexibly connected end-to-end and allowing for a wide range of utility umbilical system arrangements such that the several positions of the rig 52 may be accommodated.

Turning now to FIG. 2-19, several views of a utility umbilical module 102 are shown. The utility umbilical module 102 may be adapted to convey fluid and/or power from one end to the other and may be adapted for connection, at one or more ends, to the utility plant, another utility umbilical module, and/or the drill rig. The utility umbilical module may also be adapted for extending its length and may further be adapted for over the road transport. As shown, the utility umbilical module may include a frame portion 104, a ground engaging system 106, a fluid system 108, and an electrical system 110.

Figure 6:
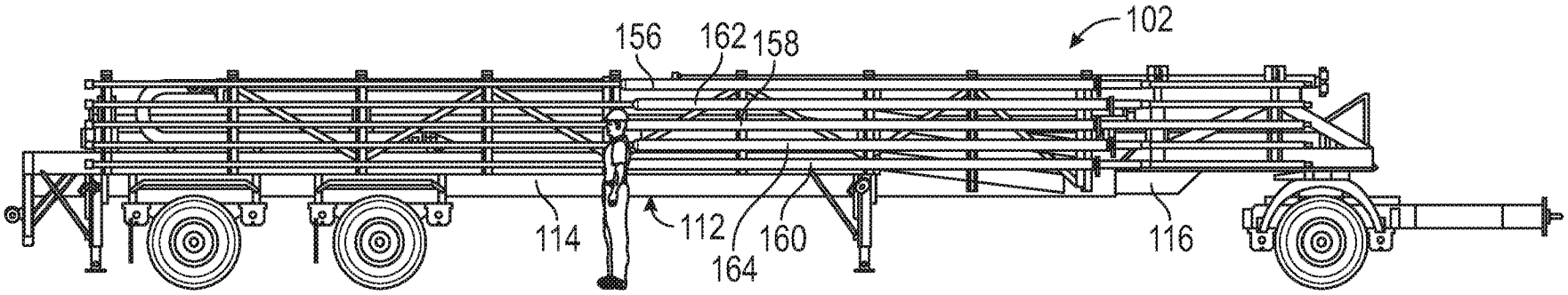
FIG. 6 is right side view of the utility umbilical module in a retracted arrangement, according to one or more embodiments.
Figure 7:
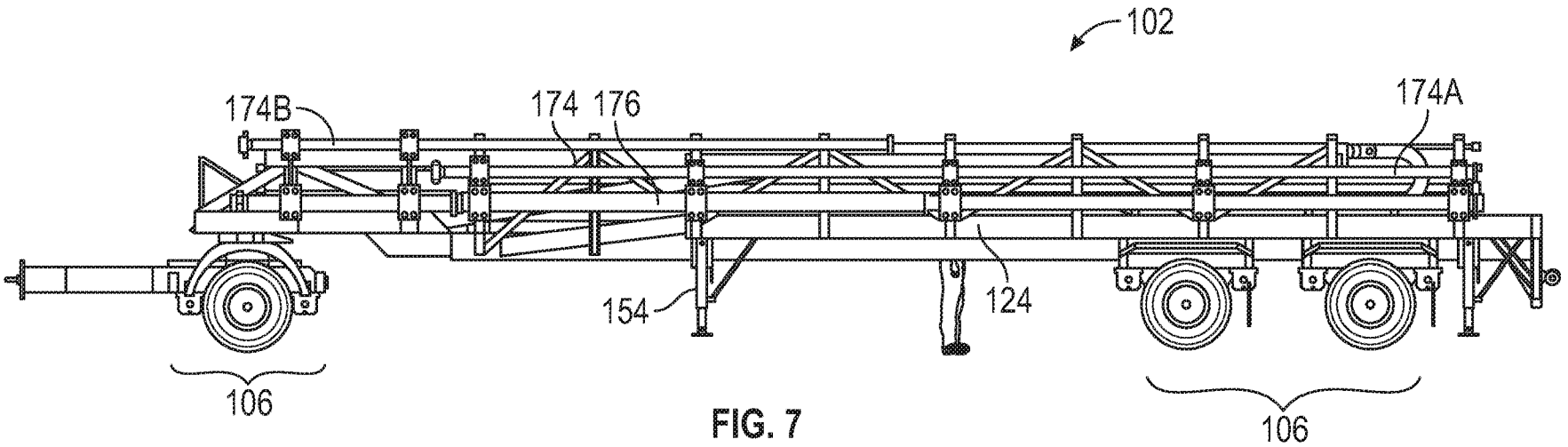
FIG. 7 is left side view of the utility umbilical module in a retracted arrangement, according to one or more embodiments.
Figure 8:
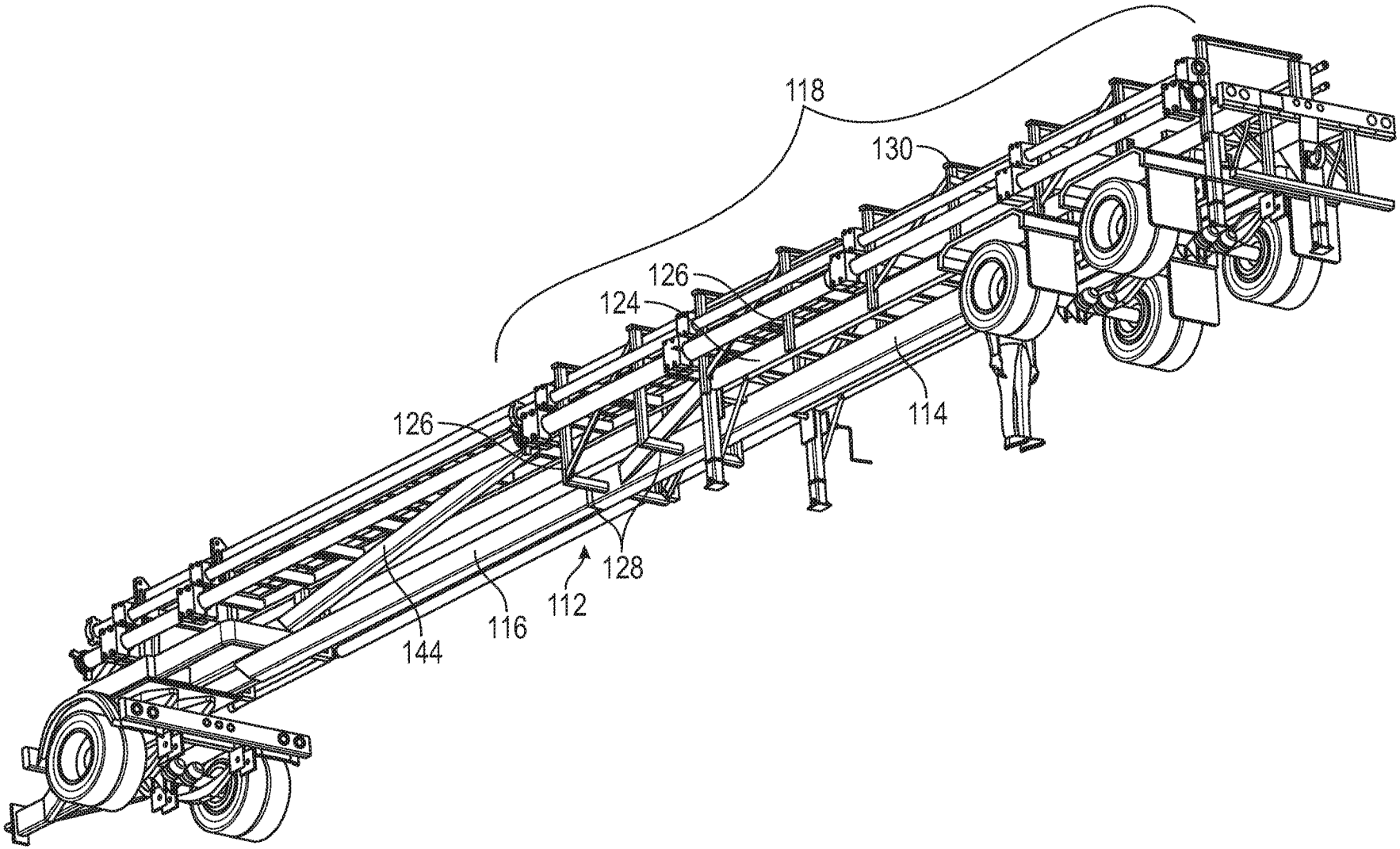
FIG. 8 is rear/left perspective view of an underside of the utility umbilical module in an extended arrangement, according to one or more embodiments.

The frame portion 104 of the utility umbilical module 102 may be configured to support the fluid and electrical systems relative to the ground and via the ground engaging portion. As such, the frame portion 104 may rely on the ground engaging portion 106 for support and may span between, across, through, or over the ground engaging portion 106. As shown in FIGS. 6-8, the frame portion 104 may include a central spine portion 112 with a utility supporting superstructure. The spine portion 112 may extend generally longitudinally along a centerline of the module 102 and may be supported at a rear end by one or more axles and/or suspension systems and at a front end by one or more axles or suspension systems. In one or more embodiments, the spine portion may include a box-like cross-section. Alternatively or additionally, the spine portion may include an I-beam cross-section, a circular cross-section, a C-channel cross-section or another structural steel shape or other shape. In one or more embodiments, generally hollow cross-sections (e.g., such as circular, square, or rectangular cross-sections) may be used that may lend themselves well to telescopically receiving a similar, but smaller, shaped cross-section or another shaped cross-section. Still other cross-sections may be used. The spine portion may be constructed of structural steel, aluminum, or other materials suitable for trailer construction.

Figure 9:
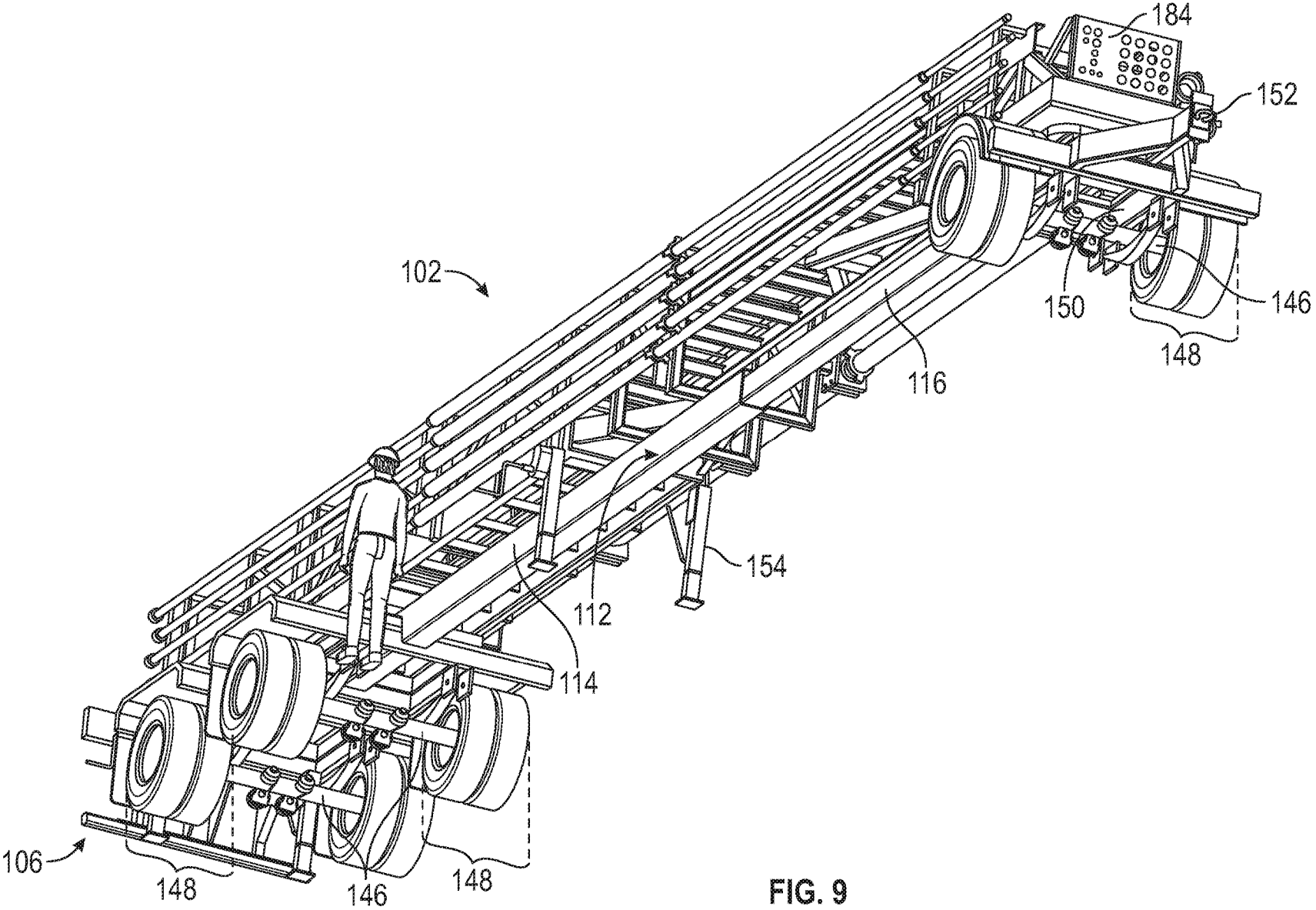
FIG. 9 is front/right perspective view of an underside of the utility umbilical module in an extended arrangement, according to one or more embodiments.

As shown in FIGS. 8 and 9, for example, the spine portion 112 may include a receiving portion 114 and a telescoping portion 116. The receiving portion 114 may be a relatively long portion beginning at or near the rear end of the spine portion 112 and extending forward. In one or more embodiments, the receiving portion 114 may extend forward for a length equal to a large majority of the collapsed or retracted state of the trailer as shown in FIGS. 6 and 7. The telescoping portion 116 may telescopically engage the receiving portion 114 such that the telescoping portion may adjustably extend out of the receiving portion. As shown, the telescoping portion 116 may have a length similar to the receiving portion 114 such that when the telescoping portion is extended from the receiving portion, an overlap length is maintained to transfer the shear and bending forces between the two portions. In one or more embodiments, an overlap length of approximately ⅓ or ½ of the front to back length of module may be maintained.

Figure 4:
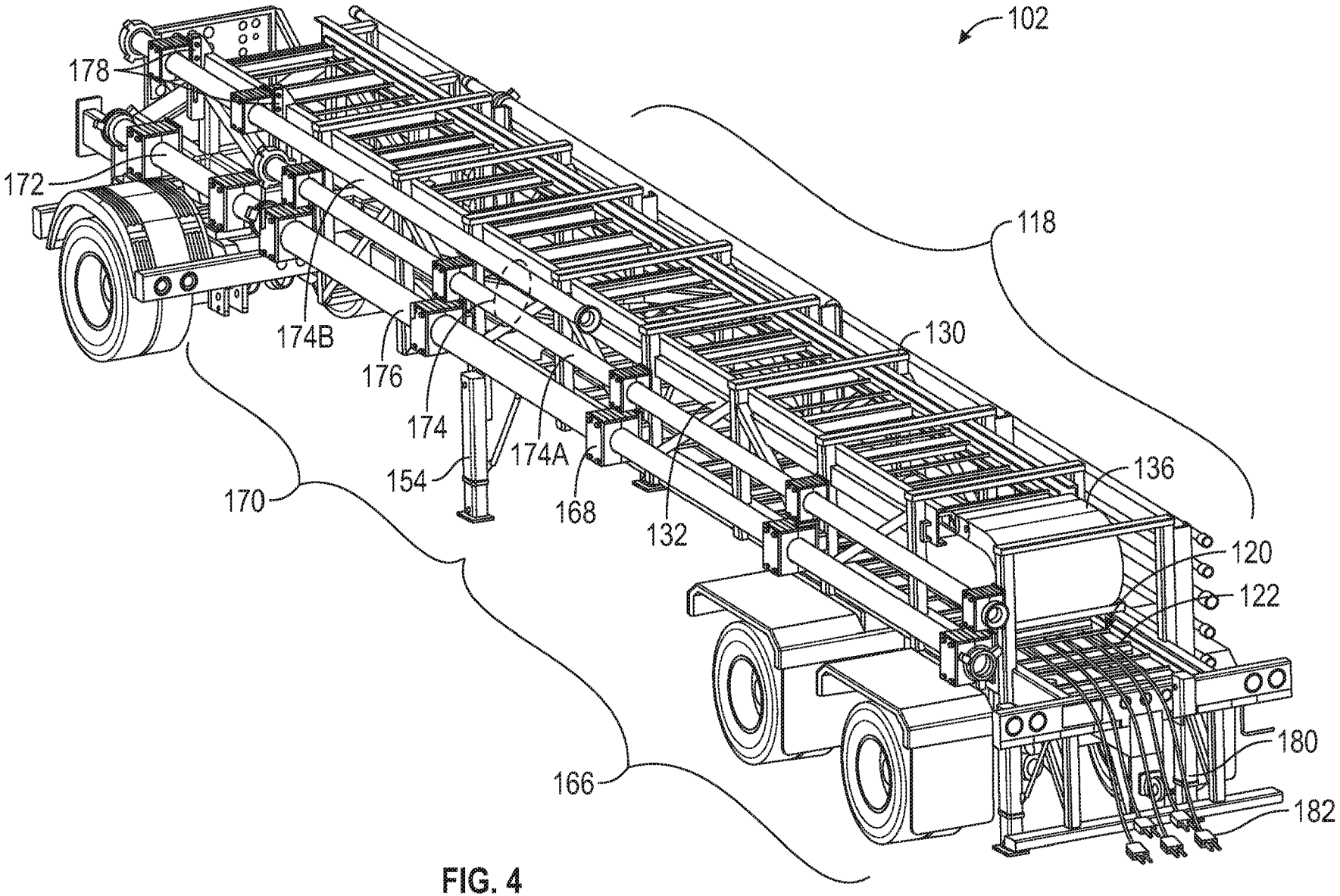
FIG. 4 is a rear/left perspective view of the utility umbilical module in a retracted arrangement, according to one or more embodiments.
Figure 5:
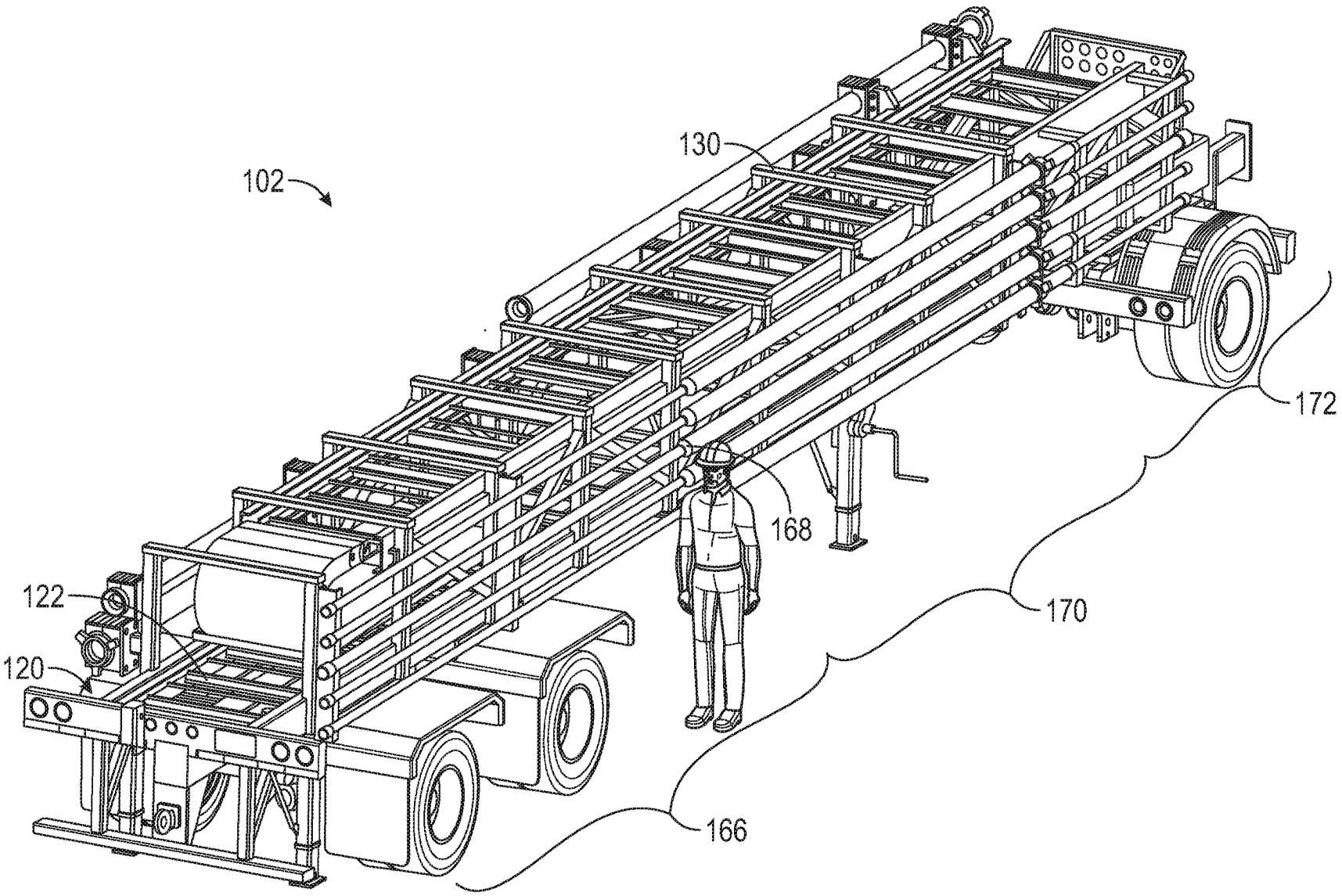
FIG. 5 is a rear/right perspective view of the utility umbilical module in a retracted arrangement, according to one or more embodiments.

The utility supporting superstructure may include framing extending upward from the spine portion 112 that is particularly adapted to manage cable and piping while accommodating telescoping operations. As shown best FIG. 10, the superstructure on a rear portion of the module (e.g., the portion associated with the receiving portion of the spine) may include framing in the form of a cage, corral, or chute, 118 for example. As shown in FIGS. 4, 5, and 9, the cage 118 may include a lower deck 120 configured for supporting electrical cabling and/or portions of a drag chain extending across a top surface of the lower deck 120. The lower deck 120 may include a plurality of cross-members 122 arranged transversely to the spine portion 112 and extending across the top of and being supported by the spine portion 112. The cross members 122 may include tubes, pipes, channels, or other structural members that, when spaced apart from one another along the spine portion, create a rear and lower cable deck as shown, for example, in FIGS. 4, 5, and 12. The cross members 122 may be tied together longitudinally by a pair of outboard runners. With reference to FIG. 8, the outboard runners 124 may be supported off the end of the cross members and may tie the cross members together. The runners 124 may extend from a rear portion of the module longitudinally forward and may converge inward toward a front end and into opposing sides of the receiving portion of the spine. Further forming the cage may be a series of uprights 126 extending generally vertically from the outboard runners. The uprights 126 may be arranged at similar locations to the cross members or another spacing may be used. Where the runners converge, arms 128 extending laterally from the spine portion may support the uprights. The tops of the uprights may be tied together by upper cross members 130 extending across the module above the lower deck and, together, defining an upper boundary of the cage 118. The sides of the cage may include alternating diagonals forming a truss-like structure to add to the stiffness of the system. A rail 132 may be provided along the inside of the uprights 126 on each side of the module at or near the top end of the uprights and below the upper cross members. The rail 132 may function to receive and/or guide an upper deck 134 extending from a front portion of the module.

Figure 10:
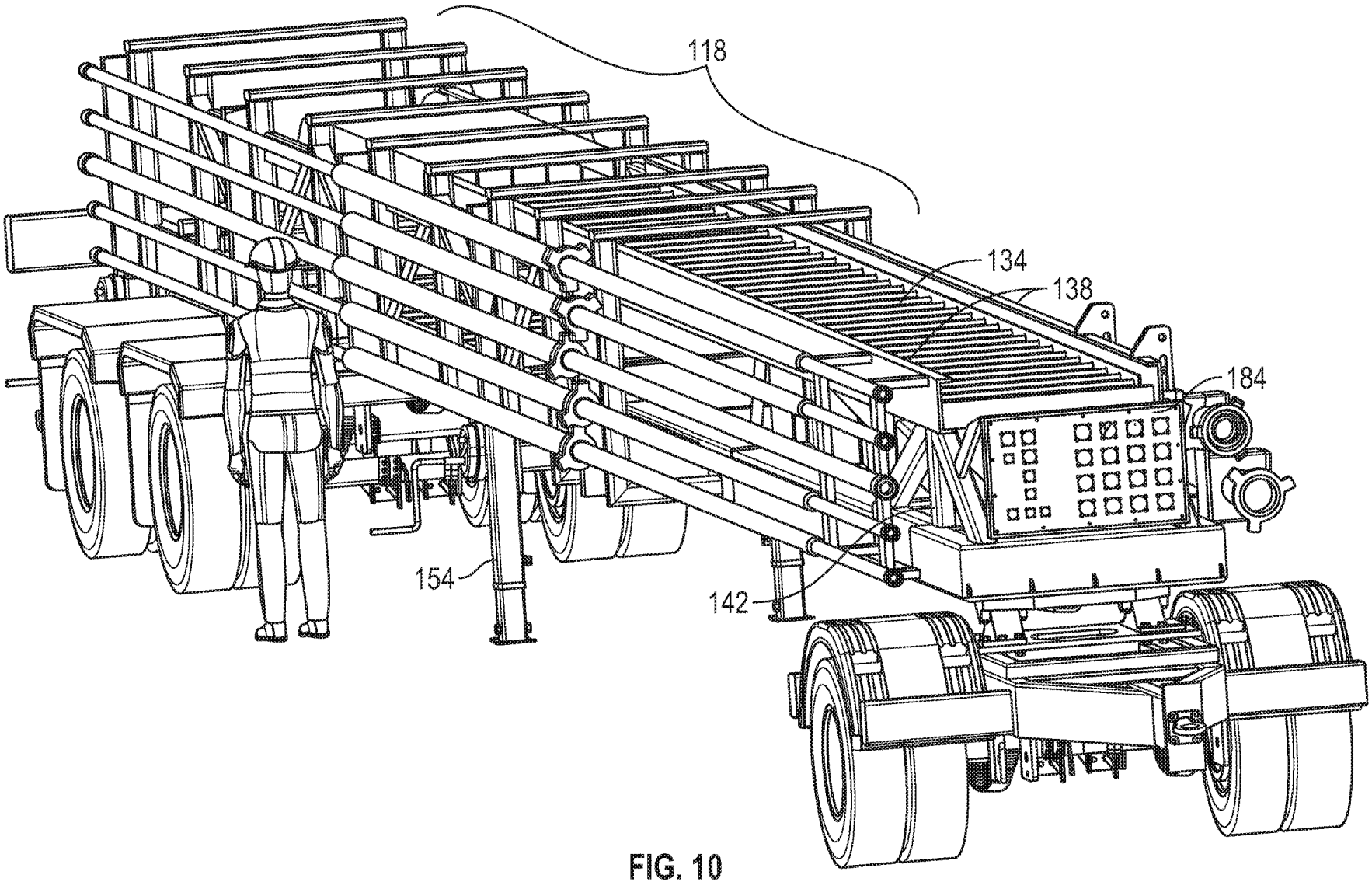
FIG. 10 is a front/right perspective view of the utility umbilical module in an extended arrangement, according to one or more embodiments.
Figure 11:
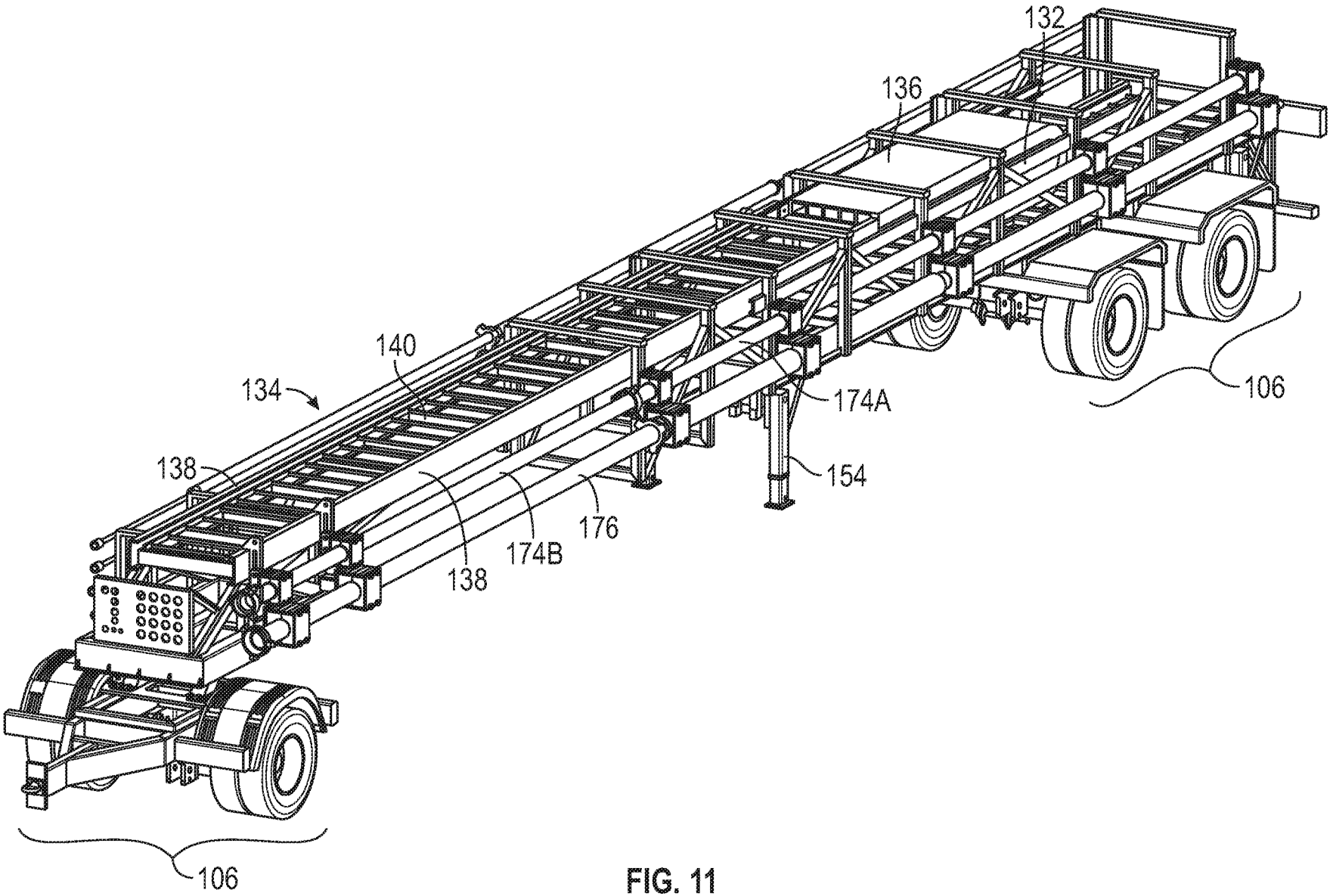
FIG. 11 is a front/left perspective view of the utility umbilical module in an extended arrangement, according to one or more embodiments.
Figure 12:
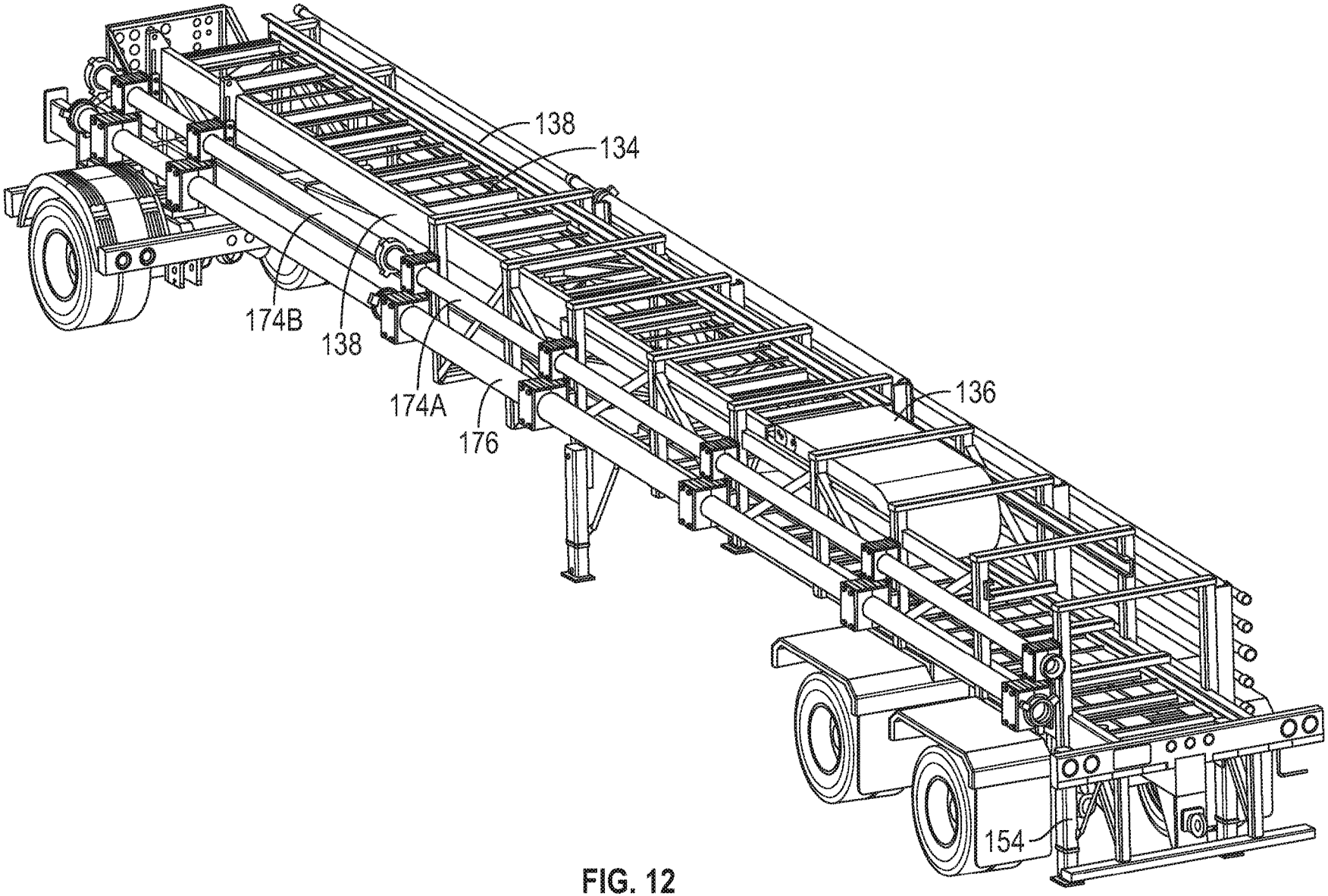
FIG. 12 is a rear/left perspective view of the utility umbilical module in an extended arrangement, according to one or more embodiments.
Figure 13:
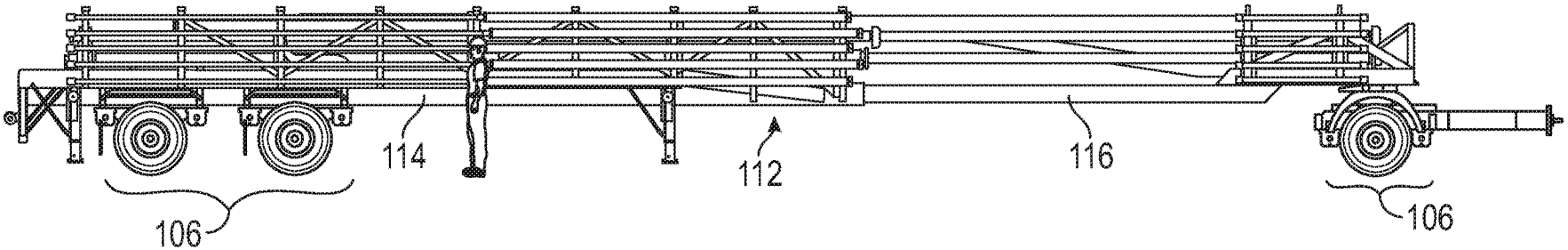
FIG. 13 is right side view of the utility umbilical module in an extended arrangement, according to one or more embodiments.
Figure 14:
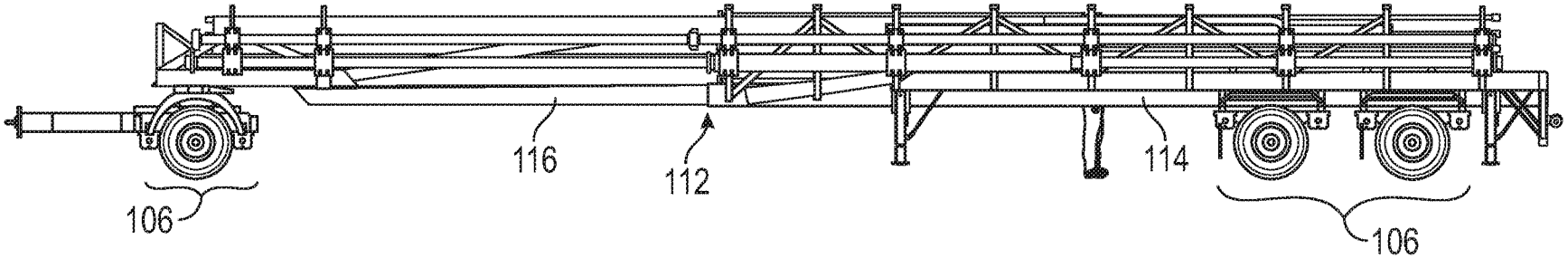
FIG. 14 is left side view of the utility umbilical module in an extended arrangement, according to one or more embodiments.

With reference to FIGS. 10 and 12, the superstructure on a front portion of the module may generally include an upper deck 134 configured for telescopically engaging and/or extending from the cage 118 on the rear portion of the module. Like the lower deck 120, the upper deck 134 may also be configured for supporting electrical cabling and/or portions of a drag chain 136. The upper deck 134 may extend rearwardly from a front end of the module and may be spaced upward and/or above the lower deck 120 such that when the module is in a retracted or collapsed condition, the upper deck 134 is positioned within the cage 118 and above the lower deck 120. The upper deck 134 may include a pair of longitudinally extending channels 138 arranged generally on outboard sides of the module and having cross members 140 spanning across the width of the module from a channel 138 on one side to an opposing channel 138 on the other side. The upper deck 134 may be supported by a front portion of the module as well as by the back portion. That is, as shown, the longitudinally extending channels 138 may each be supported at a front end of the module by a vertical post 142 and a pair of braces. As shown in FIG. 8, a knee brace or other supporting member 144 may extend diagonally and rearwardly to support the upper deck at a more rearward point. For example, the knee brace 144 may extend from a front of the module and a height at or near the spine portion rearwardly and upwardly to a bottom side of the upper deck. In one or more embodiments, the longitudinally extending channels 138 may be supported at a rear most end by a support cage 118 on a back portion of the module. That is, as discussed above, the cage 118 may include a rail 132 on an inside of the uprights 126. The longitudinally extending channels 138 may be spaced apart from one another to allow them fit within the rails 132 on the cage 118. Rollers, slides, or other supporting guide mechanisms may be provided on the rails 132 for receiving and guiding the longitudinally extending channels 138. Accordingly, as the module telescopes, the telescoping portion 116 of the spine 112 may reciprocate within the receiving portion 114 while the upper deck 134 reciprocates into and out of the cage 118.

The ground engaging system 106 may be arranged below the frame portion 104 and may function to support the frame portion during substantially stationary operations, short drill pad moves, and in over-the-road conditions. As shown, the ground engaging system 106 may include rear wheel structures and front wheel structures. The rear wheel structures may include one or more rear axles 146 with dual wheels 148 on each end thereof. The axles 146 may extend across the module from one wheel structure to another and function to support the rear portion of the frame 102. A suspension system such as a leaf spring system may be provided between the axles and the frame portion. Still other suspension systems may be provided. The wheels on the module may include wheels suitable for the over-the-road travel and, as such, may include truck rims and tires or rims and tires similar in size and load rating to trucking rims and tires. In one or more embodiments, 215/75R 17.5 LRH tires may be provided. The rear wheel structures may be fixed in orientation relative to the frame, as shown, or pivoting rear wheel structures may be provided to assist with maneuverability on site or in small turnaround areas on roadways, for example.

The front wheel structures may also include one or more axles 146 with dual wheels 148 on each end thereof and a suspension system. Like the rear wheel structures, the rims and tires may be similar in size and load rating to trucking rims and tires. However, unlike the rear wheel structure shown, the front wheel structures may include a pivot frame 150. That is, as shown, a steering frame 150 may be provided between the front wheel structures and the frame portion 104 of the module 102. The steering frame 150 may include forward extending arms leading to a trailer hitch 152 or other coupling mechanism. Other than having a suspension between the front wheel structure and the steering frame, the front steering frame may be substantially rigidly secured to the axle so as to pivot therewith. The steering frame 150 may be pivotally secured to the frame portion of the module. As such, the steering frame 150 may be pulled via the hitch 152, which may cause the front wheel structure to pivot or turn in the direction it is being pulled, which may, in turn, cause the front wheel structure to track the direction it is being pulled and turn the front end of the trailer. It is noted that the trailer hitch 152 may be a ball and socket type hitch, or another pivotal connection. As such, dual pivot points (e.g., at the hitch itself and at the front wheel assembly) may be provided at the front wheel structure with respect to another attached vehicle, plant, module, or drill rig.

Additional ground engaging support to the module may be provided by one or more down riggers or posts 154. As shown, the module may include a pair of down riggers or posts at, near, or just rearward of a front end of the rear portion of the module. The down riggers 154 may include a rigidly attached sleeve portion and an adjustable telescoping portion, which may be adjusted with a crank, for example. The telescoping portion may include a foot on a bottom end thereof for engaging the ground and absorbing a portion of the vertical load on the trailer. A similar pair of down riggers 154 may be provided at a rear end of the module behind the rear wheel structures.

Figure 3:
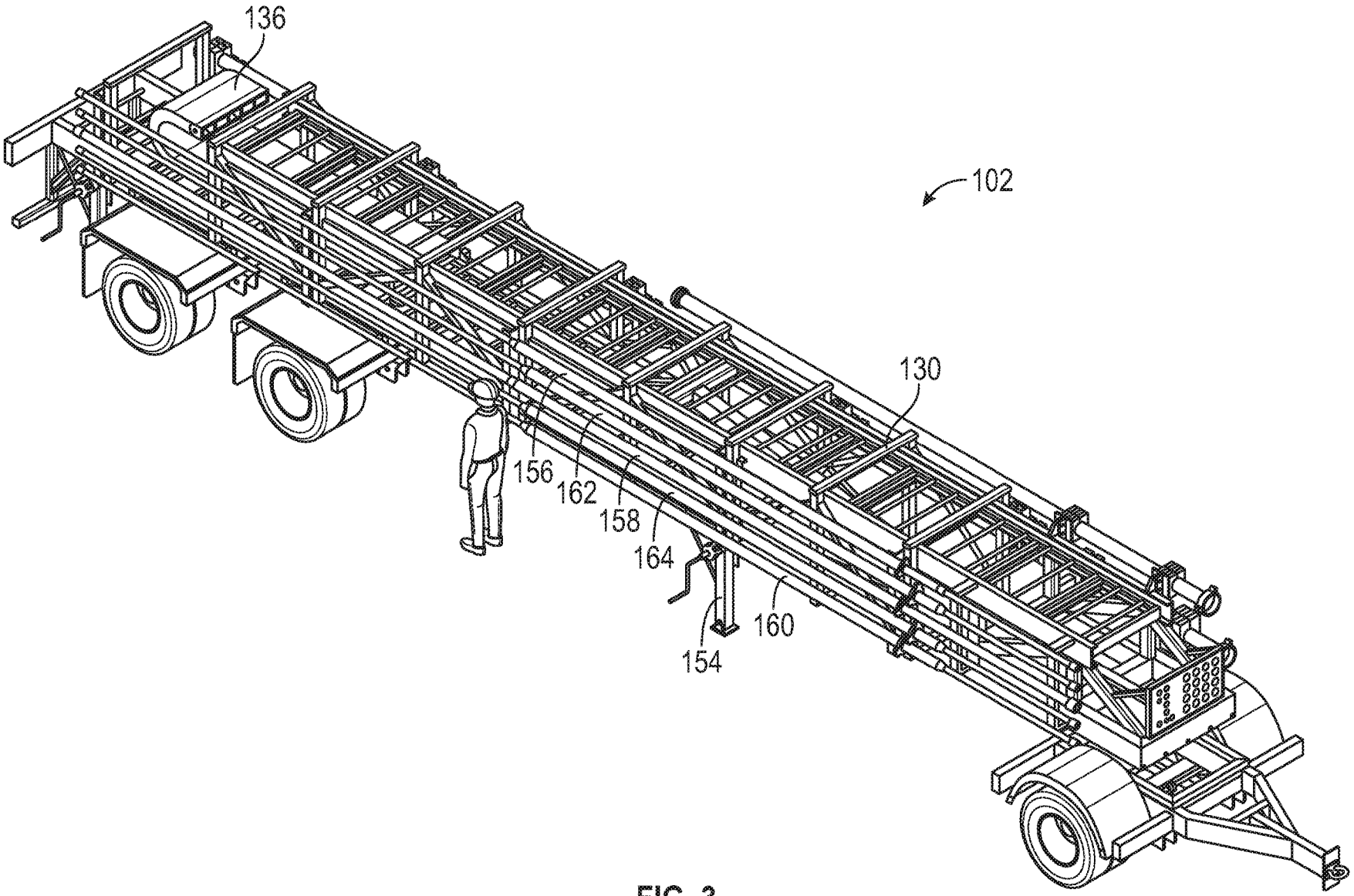
FIG. 3 is a front/right perspective view of the utility umbilical module in a retracted arrangement, according to one or more embodiments.
Figure 17:
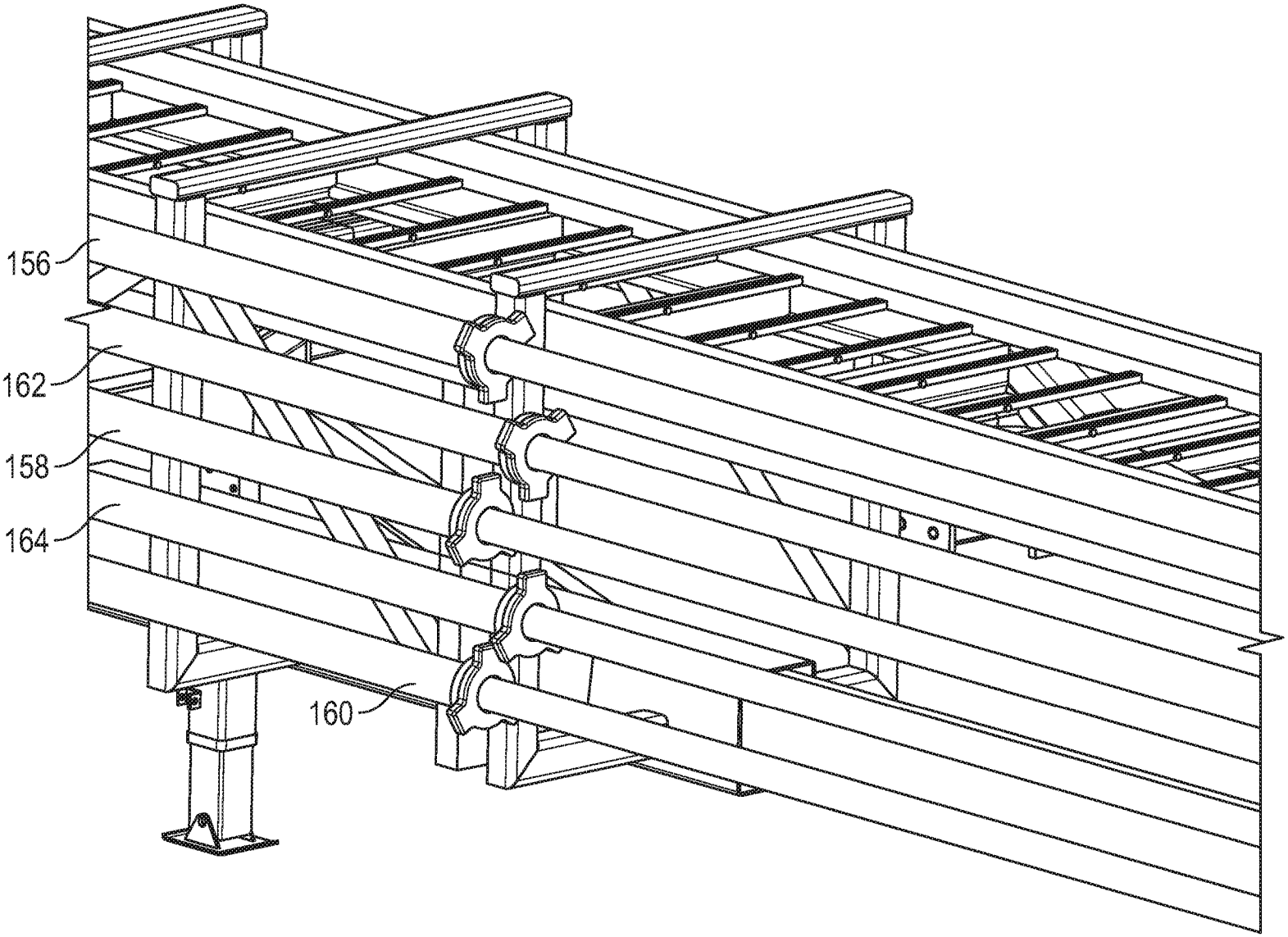
FIG. 17 is a close-up view of telescoping piping fittings, according to one or more embodiments.
Figure 18:
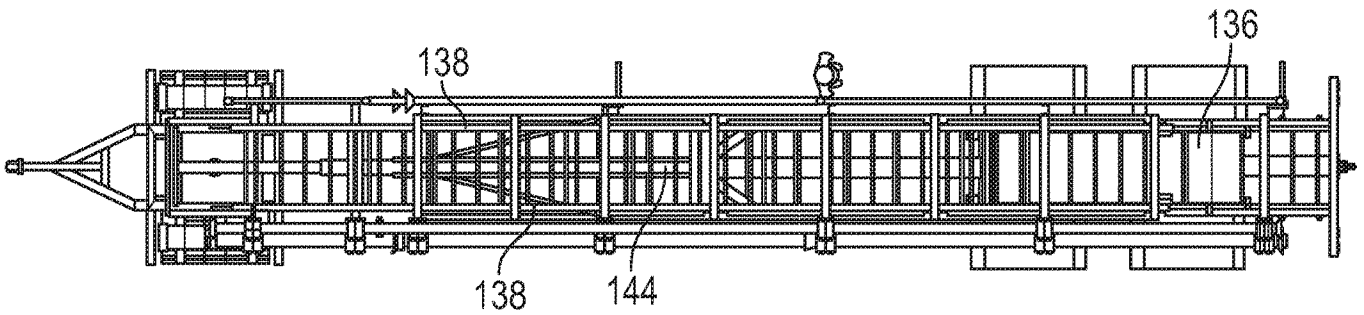
FIG. 18 is a top view of the utility umbilical module in a retracted arrangement, according to one or more embodiments.
Figure 19:
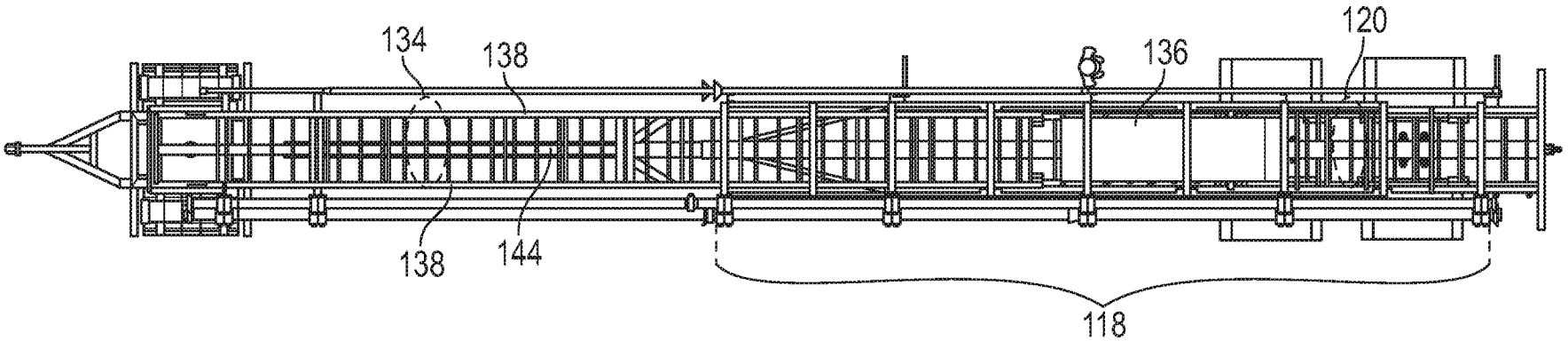
FIG. 19 is a top view of the utility umbilical module in an extended arrangement, according to one or more embodiments.

The fluid system 108 may be arranged on the frame portion 104 and may be configured to carry supply and return fluids between the utility plant and the drill rig. The fluids may include drilling fluid, water, steam, air, and/or other liquids or gases. As shown in FIG. 3, for example, several fluid lines may be provided on a side of the module. The fluid lines may be substantially straight lines extending longitudinally along a side of the module and supported on brackets secured to the uprights of the cage. As shown, the lines may include an air supply line 156, a steam supply line 158, a steam return line 160, a water supply line 162, and a water return line 164. For purposes of telescoping, as shown in FIG. 5, each line may include a primary portion 166, a transition 168, a sleeve portion 170, and a telescoping portion 172. That is, as shown, a primary portion 166 of the line at or near the rear end of the module may include a pipe or other conduit sized to carry a selected amount of fluid. A transition 168 to a larger sleeve 170 may be provided at approximately a mid-length of the rear portion of the superstructure of the module. The sleeve may sized to receive a telescoping pipe 172, which may be of same or similar size to the primary portion. The telescoping pipe 172 may be arranged within the sleeve 170 and may be adapted to articulate out of the sleeve when the module is extended so as to allow the piping to accommodate module extension. Seals, such as hammer seals, for example, may be provided within the sleeve between a plunger end of the telescoping pipe and at the exit of the sleeve (e.g., the end opposite the transition). FIG. 17 shows a close-up view of the telescoping pipe extending from the sleeve. The front and rear ends of the fluid lines may be adapted for connection to adjoining modules, the drill rig, or the utility plant with flexible hoses or other fluid coupling devices or systems.

Referring now to FIG. 4, an opposite side of the module may include drill fluid supply piping 174 and drill fluid return piping 176. As may be appreciated, the drill fluid supply piping 174 may be high-pressure piping adapted to carry high-pressure fluid from the utility plant to the drill rig. That is, the drill fluid may be pressurized at the utility plant and carried to the drill rig at high pressures suitable for directing the fluid downhole without the need for booster pumps on the drill rig, for example. In contrast, the drill fluid return line may be a low-pressure line. Moreover, and given the relatively large volumes of drill fluid being supplied and returned to the rig, the drill fluid piping may be relatively larger than the other fluid lines.

As shown in FIG. 4, the drill fluid return line may be configured similar to the air, water, and steam lines described above. That is, a primary portion 166 of the drill fluid return line at or near the rear end of the module may include a pipe or other conduit sized to carry a selected amount of fluid. A transition 168 to a larger sleeve 170 may be provided at approximately a mid-length of the rear portion of the superstructure of the module. The sleeve 170 may sized to receive a telescoping pipe 172. The telescoping pipe may be arranged within the sleeve 170 and may be adapted to articulate out of the sleeve 170 when the module is extended so as to allow the piping to accommodate module extension. Seals, such as hammer seals for example, may be provided within the sleeve between a plunger end of the telescoping pipe and at the exit of the sleeve (e.g., the end opposite the transition).

In contrast to the drill fluid return piping, the drill fluid supply piping may include a two-part system. As shown in FIG. 4, a primary portion 174A of the drill fluid supply line at or near the rear end of the module may include a pipe or other conduit sized to carry a selected amount of fluid. The pipe may extend substantially the full length of the cage 118 of the rear portion of the superstructure and may have a length similar to the combined length of the primary portion 166, transition 168, and sleeve 170 of the other types of piping. The primary portion 174A may be secured to the uprights on the cage with brackets. A second high-pressure line 174B may be provided and supported off of the upper deck 134. The second high-pressure line 174B may be arranged in a same vertically extending plane as the primary portion 174A of the drill fluid supply line. The second high-pressure line 174B may be supported off of a stub portion of the front portion of the superstructure. That is, the second high-pressure line may be supported off of a portion of the front superstructure that does not retract fully into the cage 118. As shown, the brackets may secure a front portion 174B of the second high-pressure line and support the whole second portion of the line in cantilevered fashion as the pipe extends rearwardly along the side of the cage 118. In addition, the brackets may be sliding brackets 178 allowing the second high-pressure line to articulate upward and downward. Accordingly, as shown in FIG. 8, for example, when the module is extended, the second high-pressure line 174B may be lowered bringing it into longitudinal alignment with the primary portion 174A of the high-pressure line and allowing the two to be fluidly coupled. In one or more embodiments the second high-pressure line may be coupled to the primary line with hammer unions, for example.

The electrical system may be arranged on the frame portion 104 and may be configured to deliver electrical power, low voltage signals, and/or communications to the drill rig. Various power lines may be provided with various amperages, voltages, and phases, and low voltage lines and/or communications lines may be provided. A large number of cables may be provided for this purpose. As shown, for example in FIG. 4, the lines 180 on the module may extend off of a rear end of the module and may include plugs 182 for plugging into the utility plant or an adjacent module, such as into a plug panel of an adjacent module. The lines 180 may then extend across the lower deck 120 of the rear portion of the superstructure. The lines 180 may then return back toward the rear of the module and enter a drag chain system 136. The drag chain system 136 may include a rectangular drag chain housing having flexible sidewalls adapted to allow the housing to curl and double over on itself. That is as shown in FIG. 4, a rear portion of the drag chain housing may curl upward and forward and be secured to a rear end of the upper deck 134. As the upper deck 134 translates out of the cage 118 of the rear portion of the superstructure, the upper deck 134 may pull the rear portion of the drag chain housing forward as shown from a similar view point in FIG. 12. The lines therein may extend through the drag chain housing and outward and onto the upper deck 134 to a front end of the module. The drag chain system may, thus, provide for controlled unraveling/extension of the lines as the module is extended or retracted. The lines may be hard wired into the plug panel 184 at a front portion of the module allowing a rig, another module, or other system to be plugged into the plug panel and transfer power, signals, and/or communications.

Figure 15:
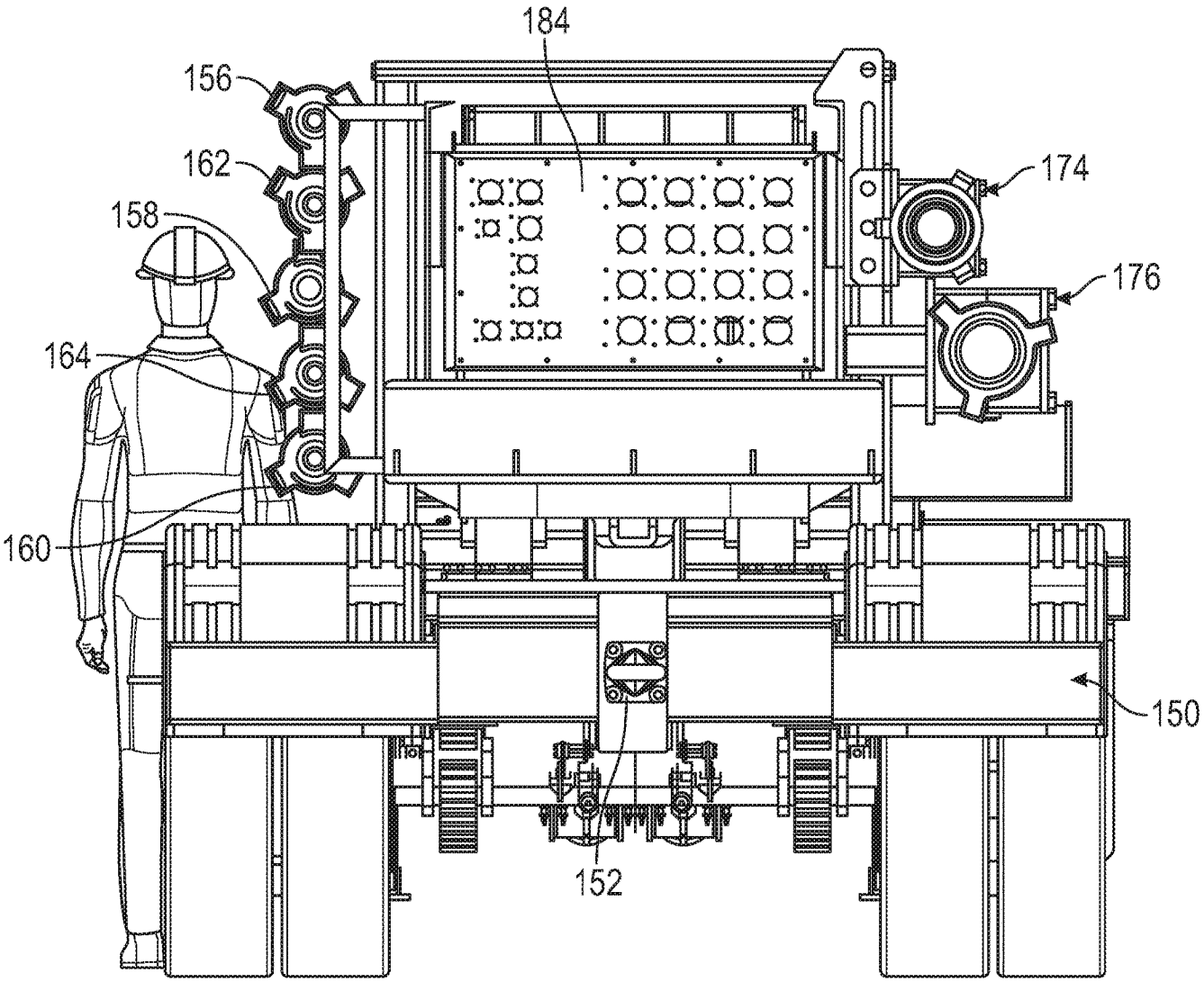
FIG. 15 is front end view of the utility umbilical module, according to one or more embodiments.

As mentioned, the module may include a plug panel 184 at a front end of the module. As shown in FIG. 15, the plug 184 panel may include a plurality of electrical outlets allowing for a rig, an adjacent module, or another system to be plugged into the module and take off power from the module. The plurality of outlets may include various types of power and phases of power and may be arranged and/or grouped as clusters of particular types of power. Still other panel designs and arrangements may be provided.

Figure 16:
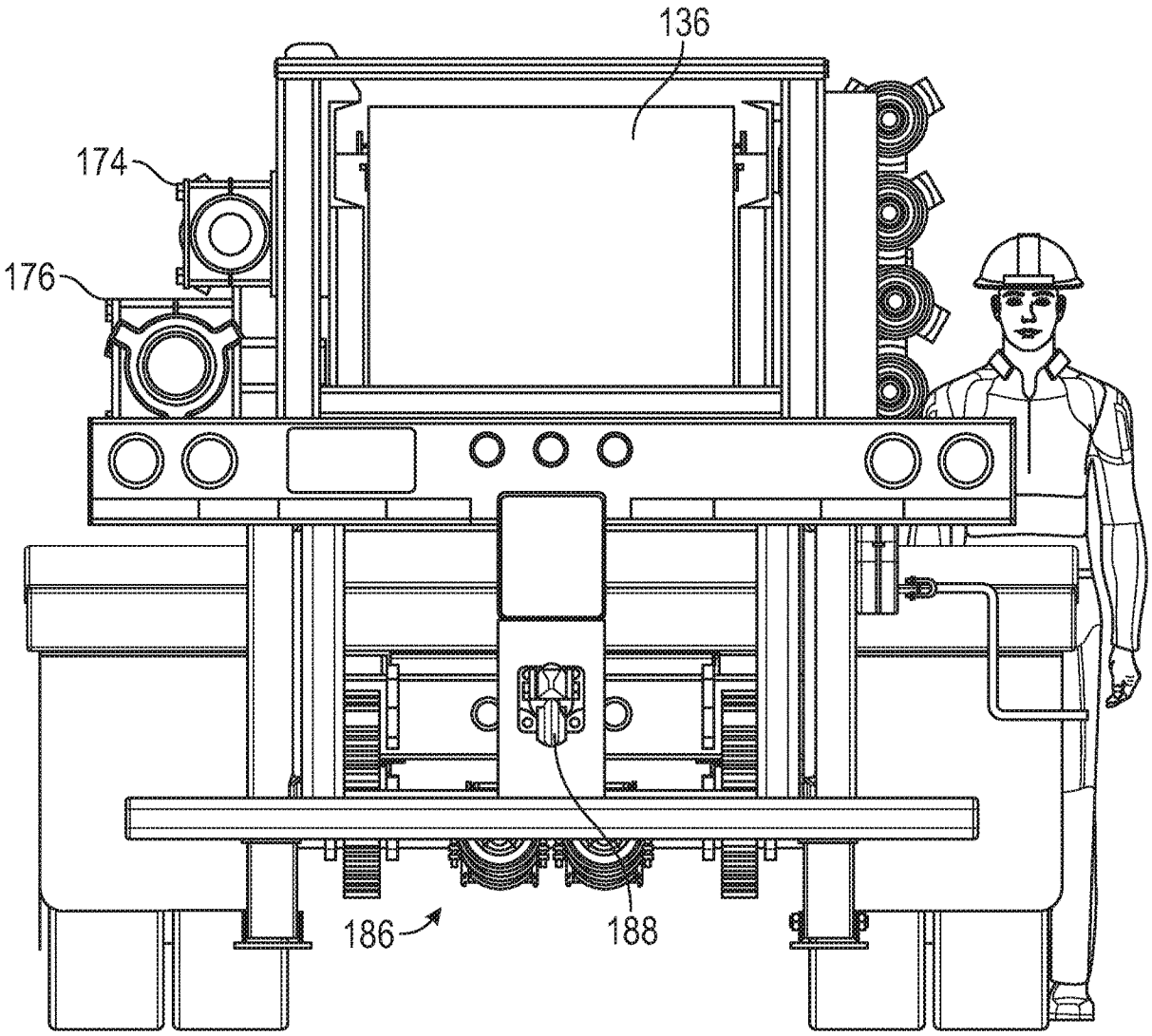
FIG. 16 is a rear end view of utility umbilical module, according to one or more embodiments.

With reference to FIG. 16, a rear end of the module is shown. As shown, the rear end of the module may include a bumper system 186 for over-the-road qualification. The rear bumper system may also include a hitch 188 allowing the module to be connected in daisy chain fashion with another module.

The trailer system may include a lock for controlling the expansion and/or retraction of the trailer. In one or more embodiments, a hydraulic pin or other actuatable mechanism may be used to engage a telescoping portion relative to a holding or sleeve portion to resist relative movement therebetween. The lock may be engaged when a selected level of expansion has occurred and/or when the trailer has been retracted and is preparing for over-the-road or other transport.

Figure 20:
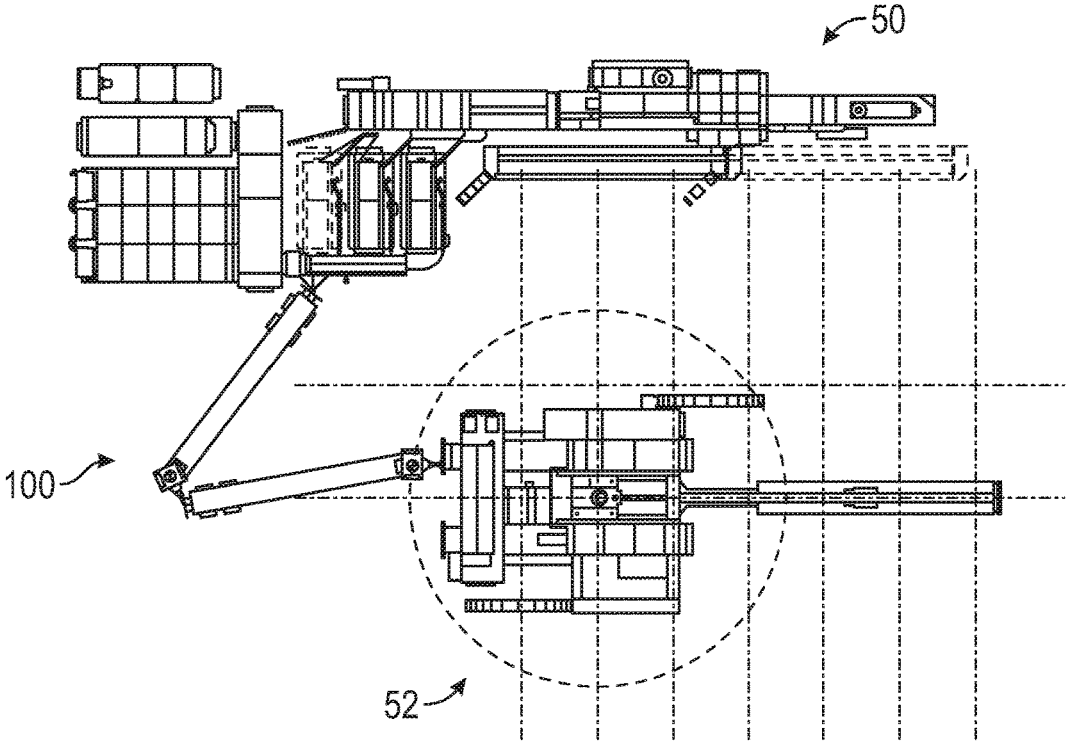
FIG. 20 is a plan view of the utility umbilical system extending between a utility system and a drill rig on a drilling pad, according to one or more embodiments.
Figure 21:
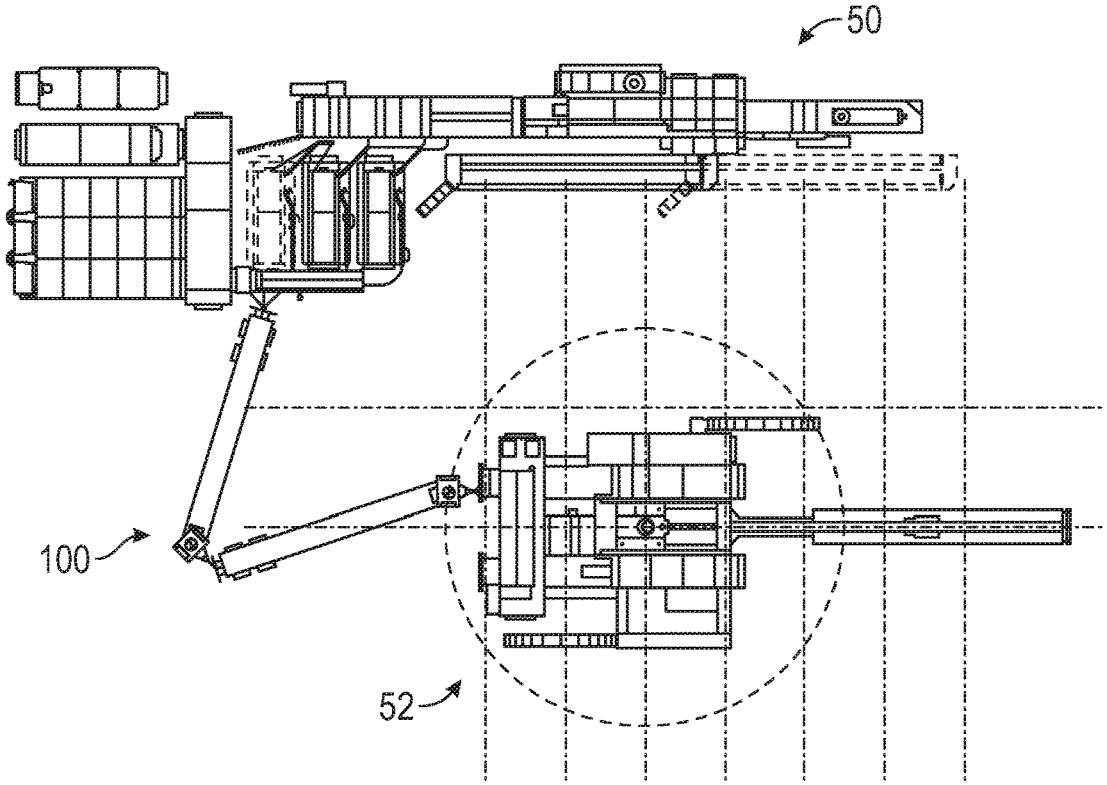
FIG. 21 is a plan view of the utility umbilical system extending between a utility system and a drill rig on a drilling pad, according to one or more embodiments.
Figure 22:
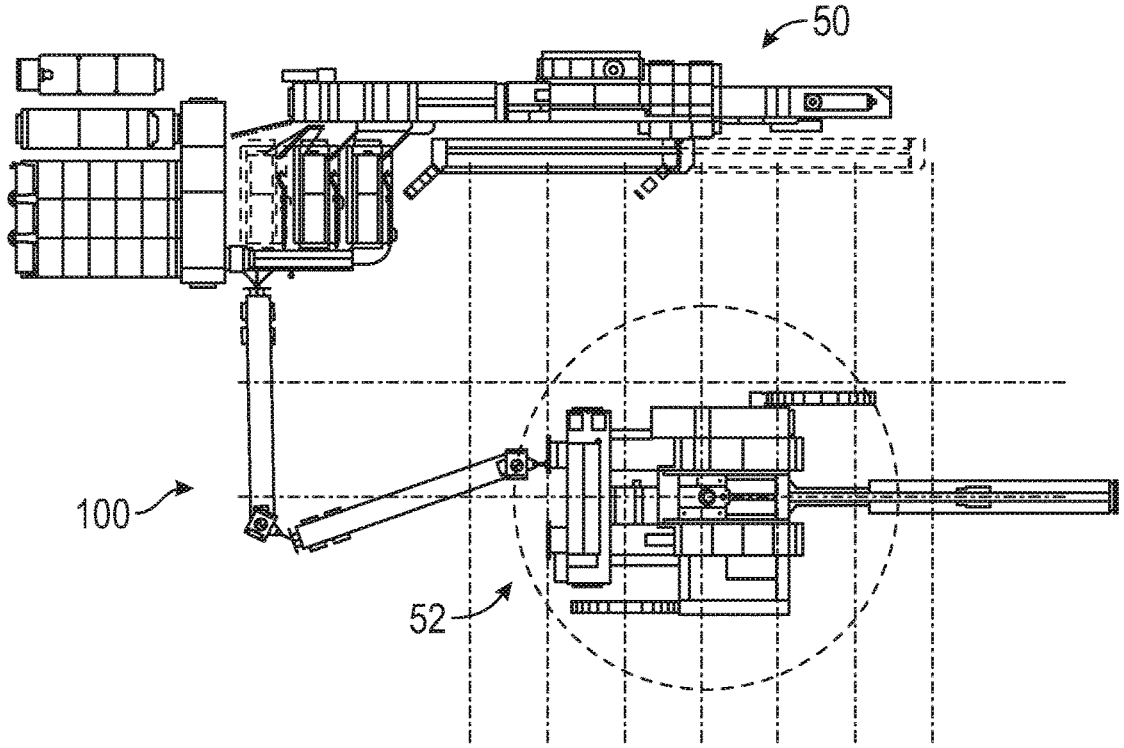
FIG. 22 is a plan view of the utility umbilical system extending between a utility system and a drill rig on a drilling pad, according to one or more embodiments.
Figure 23:
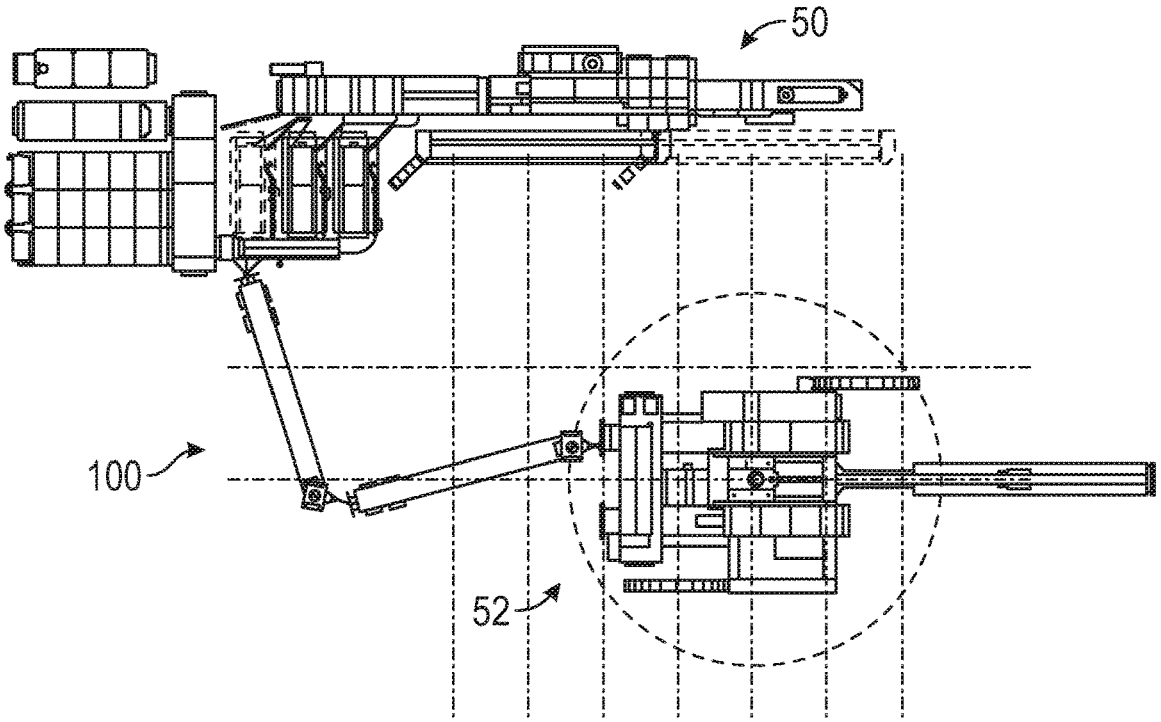
FIG. 23 is a plan view of the utility umbilical system extending between a utility system and a drill rig on a drilling pad, according to one or more embodiments.
Figure 24:
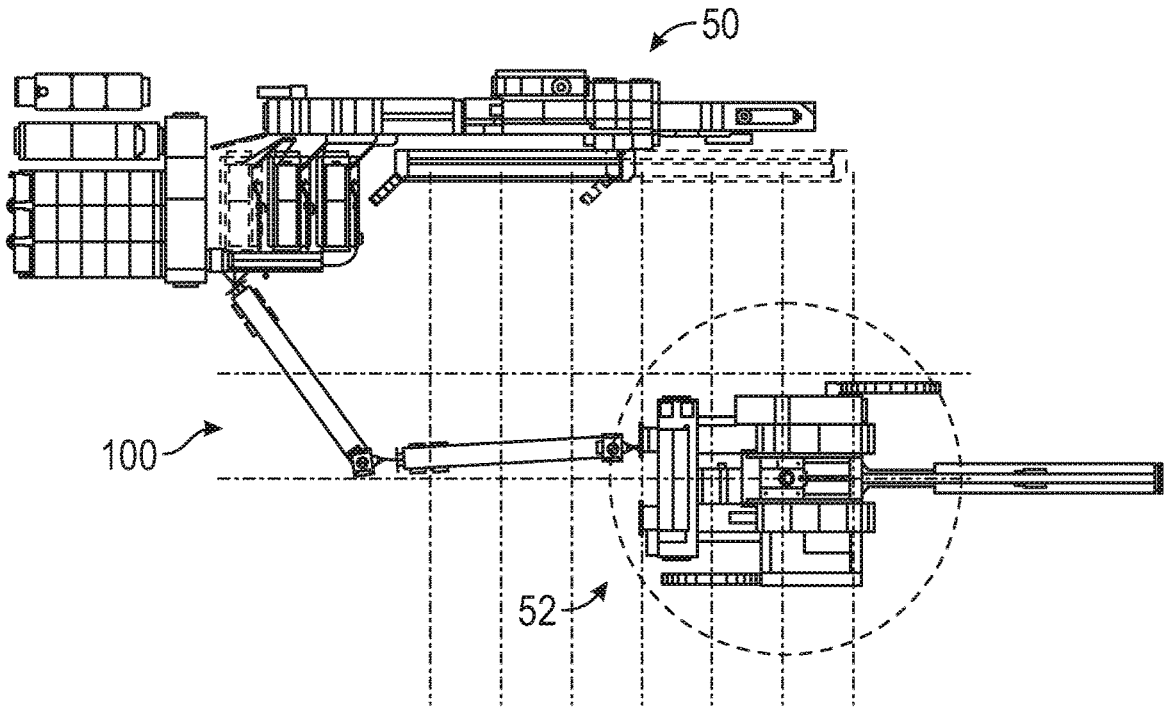
FIG. 24 is a plan view of the utility umbilical system extending between a utility system and a drill rig on a drilling pad, according to one or more embodiments.
Figure 25:
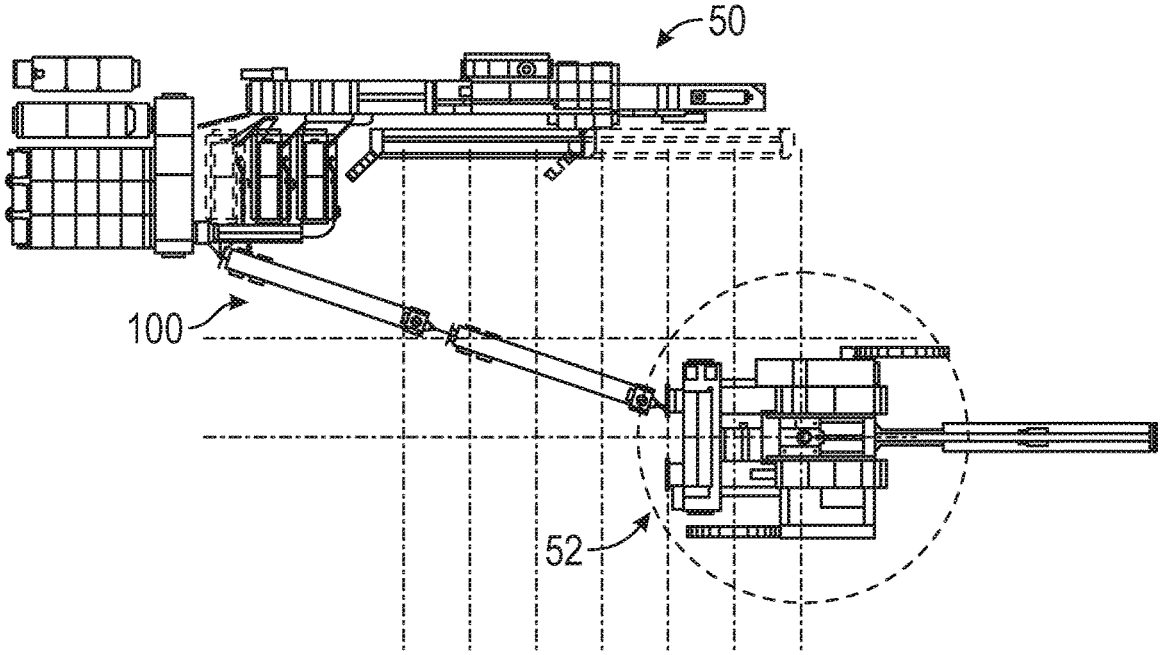
FIG. 25 is a plan view of the utility umbilical system extending between a utility system and a drill rig on a drilling pad, according to one or more embodiments.
Figure 26:
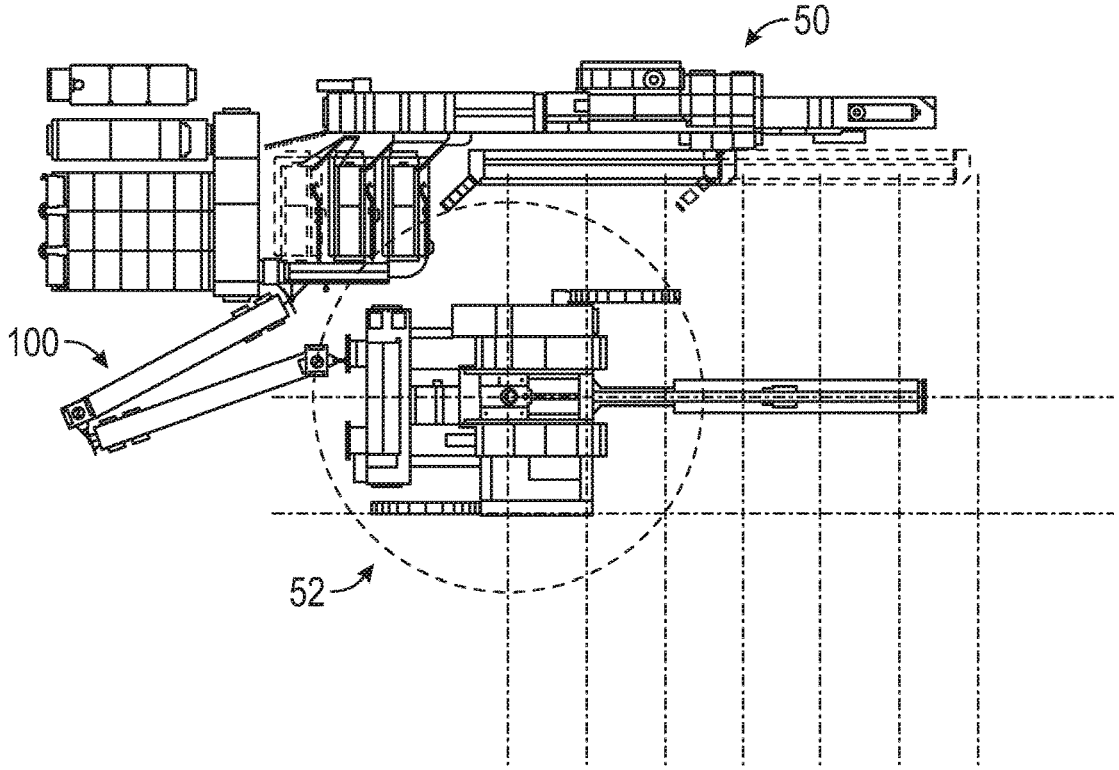
FIG. 26 is a plan view of the utility umbilical system extending between a utility system and a drill rig on a drilling pad, according to one or more embodiments.
Figure 27:
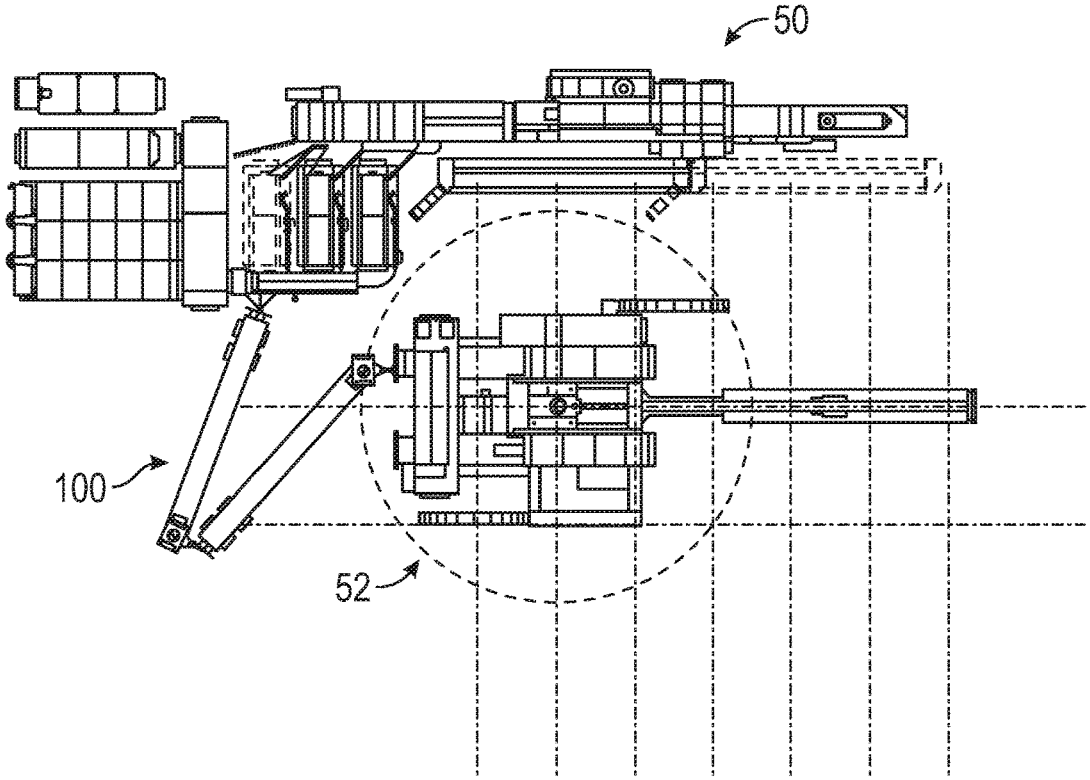
FIG. 27 is a plan view of the utility umbilical system extending between a utility system and a drill rig on a drilling pad, according to one or more embodiments.
Figure 28:
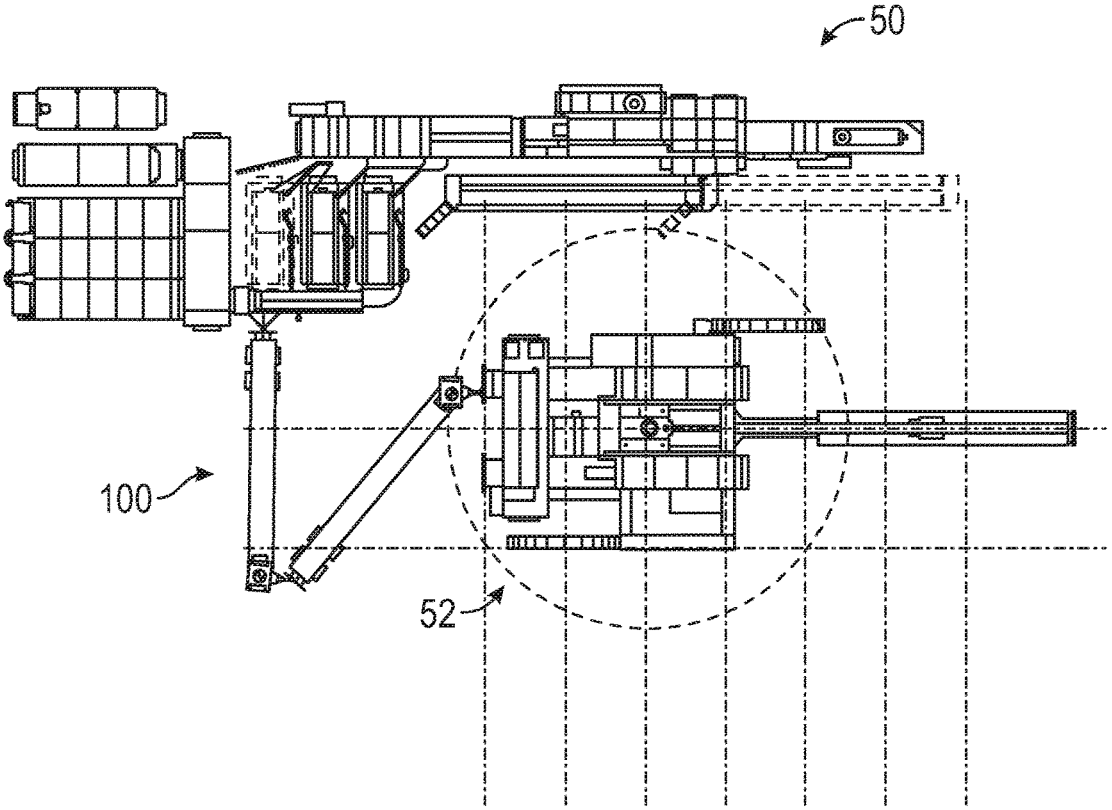
FIG. 28 is a plan view of the utility umbilical system extending between a utility system and a drill rig on a drilling pad, according to one or more embodiments.
Figure 29:
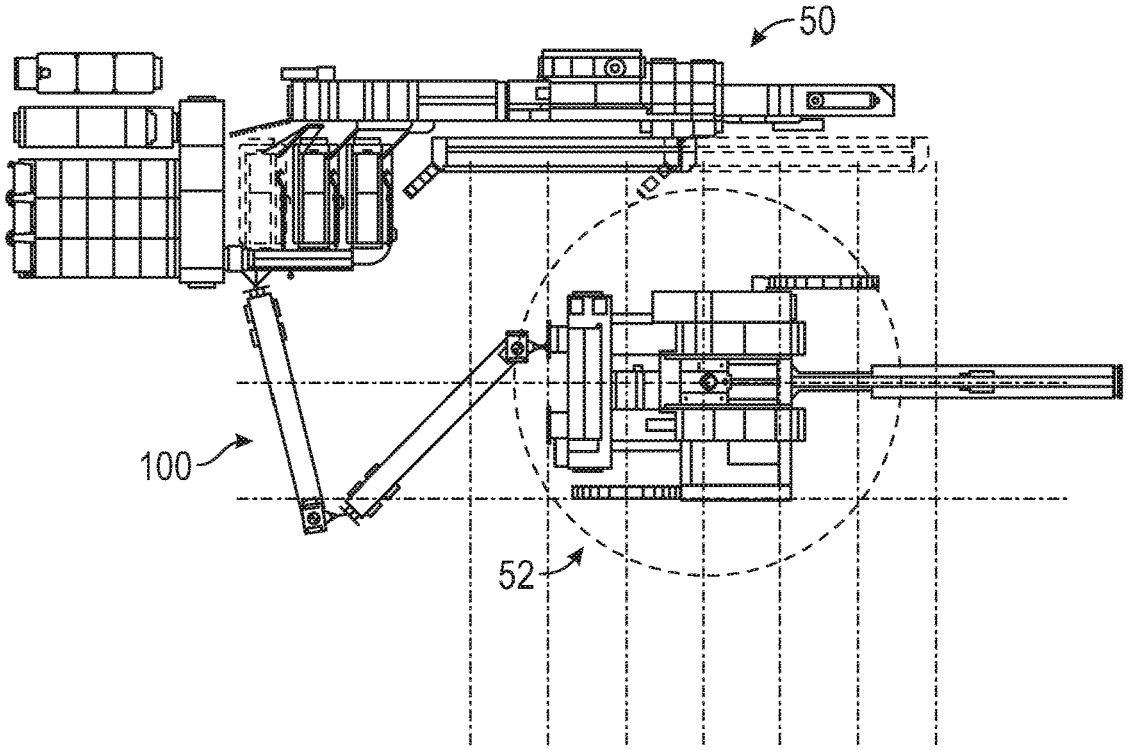
FIG. 29 is a plan view of the utility umbilical system extending between a utility system and a drill rig on a drilling pad, according to one or more embodiments.
Figure 30:
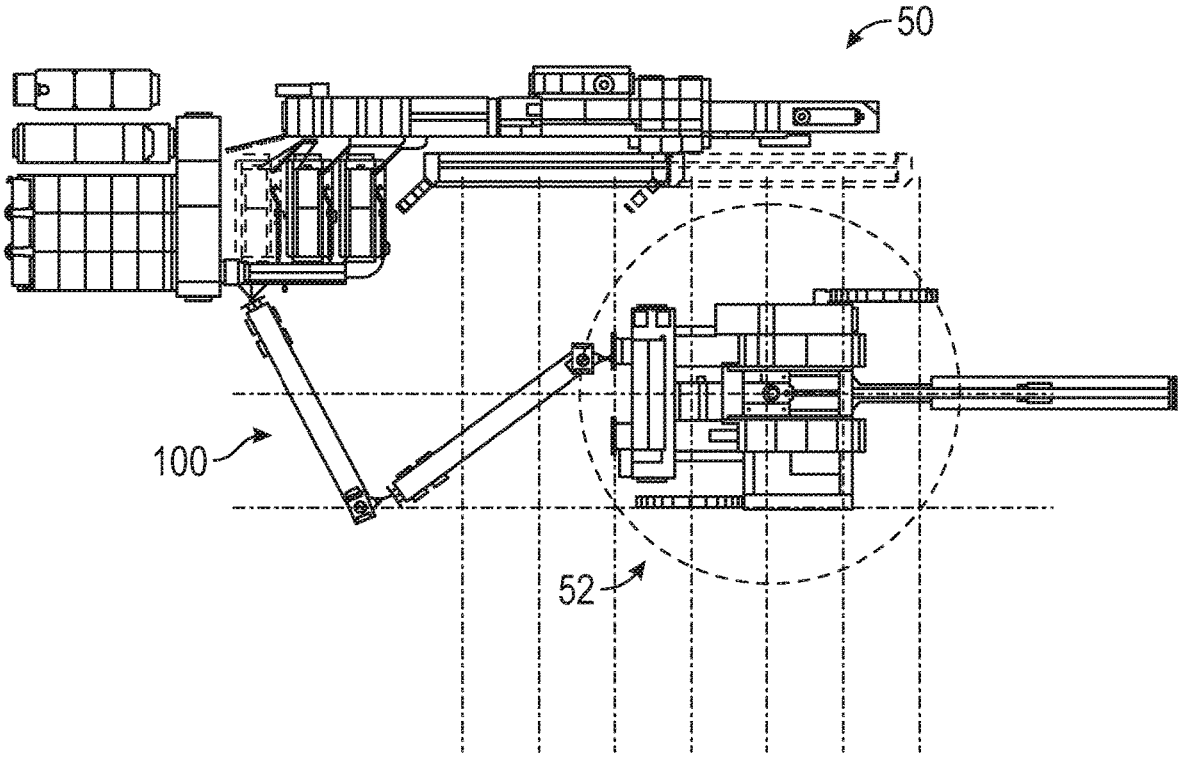
FIG. 30 is a plan view of the utility umbilical system extending between a utility system and a drill rig on a drilling pad, according to one or more embodiments.
Figure 31:
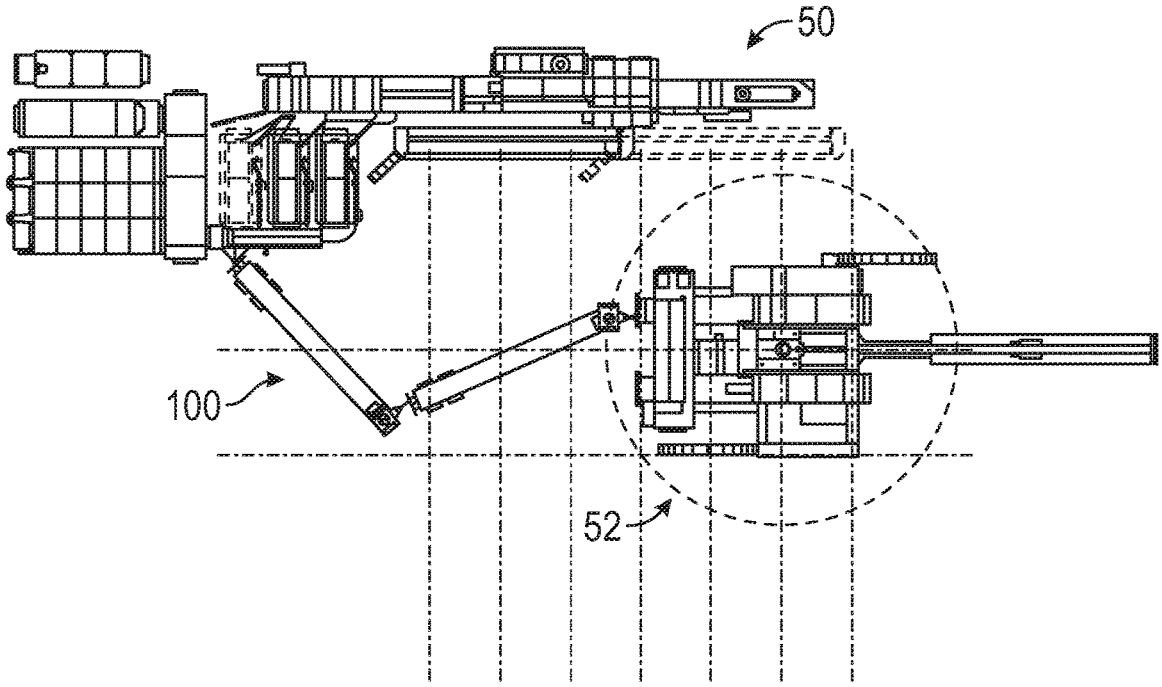
FIG. 31 is a plan view of the utility umbilical system extending between a utility system and a drill rig on a drilling pad, according to one or more embodiments.
Figure 32:
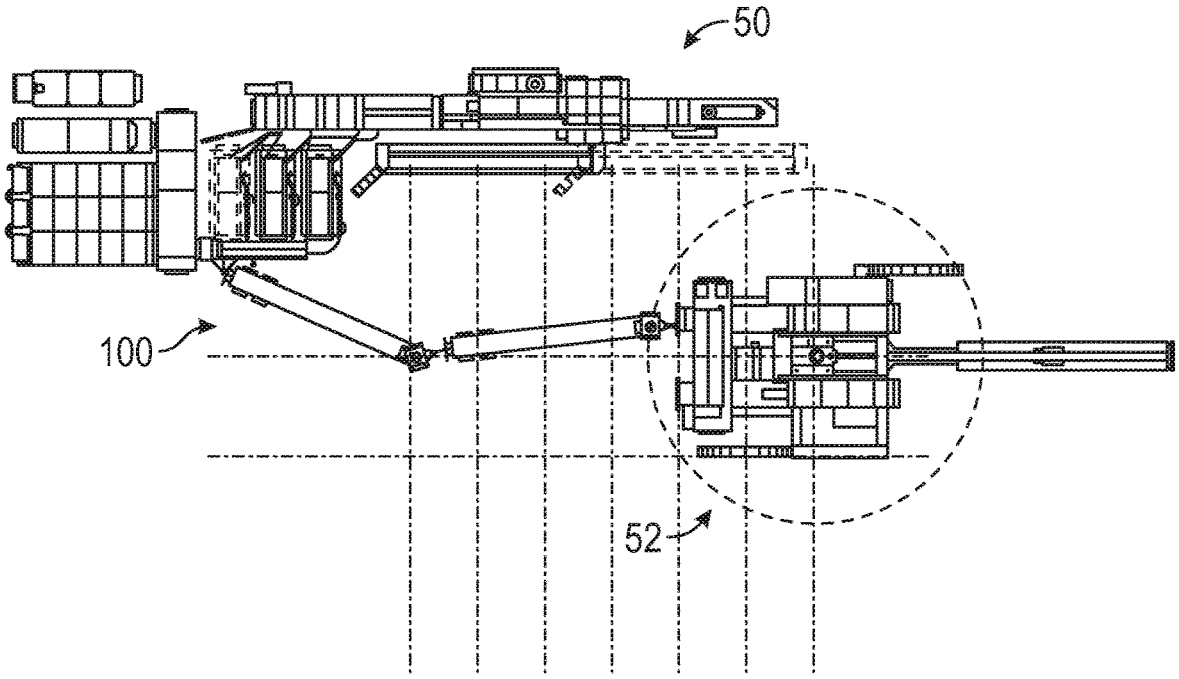
FIG. 32 is a plan view of the utility umbilical system extending between a utility system and a drill rig on a drilling pad, according to one or more embodiments.

In operation and use, one or more of the described utility umbilical modules may be used to electrically and fluidly couple a utility plant to a drill rig and allow the drill rig to move about a drilling site from pad to pad without disconnecting the electrical power or the fluid coupling from the utility plant. For example, as shown in FIG. 20, two utility umbilical modules may be used to electrically and fluidly couple the utility plant to the drill rig. In comparison to FIG. 1, it is noted that the drill rig has moved from a first drilling pad to a second drilling pad and the umbilical system has been adjusted accordingly. In particular a first module pivotally arranged at the utility plant has rotated counterclockwise about its connection point to the utility plant. A second module has shifted its position to the right to follow the drill rig and has rotated counter clockwise to accommodate the downward and rightward swinging of the swinging end of the first module. A similar motion of the two modules is seen from FIGS. 20 to 21 and from FIGS. 21 to 22. From FIGS. 22 to 23, the swinging end of the first module begins to swing back toward the utility plant causing the second module to rotate clockwise instead of counter clockwise and a similar motion is noticed from FIGS. 23 to 24 and finally from FIGS. 24 to 25 until the utility umbilical system is substantially straight and at full extension in FIG. 25. FIGS. 26-32 show a similar transition of the utility umbilical system as the drill rig moves across a set of drill pads slightly closer to the utility plan. It is to be appreciated that the dual pivot points on the modules and the relatively large over-the-road wheel structures on the modules may allow the individual utility umbilical modules and the collective umbilical system to smoothly track behind the drill rig as it moves from drill pad to drill pad. Moreover, where the drill site has relatively rough terrain, the large wheel structures may move across the terrain relatively uninhibited.

Figure 33:
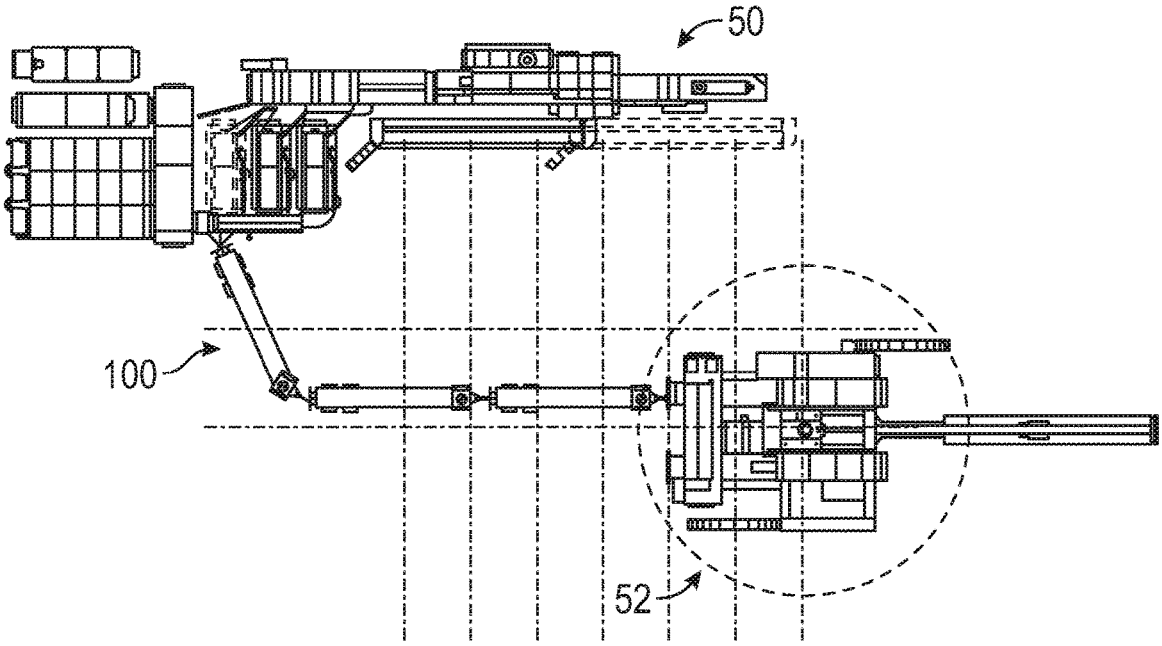
FIG. 33 is a plan view of a non-telescoping utility umbilical system extending between a utility system and a drill rig on a drilling pad, according to one or more embodiments.
Figure 34:
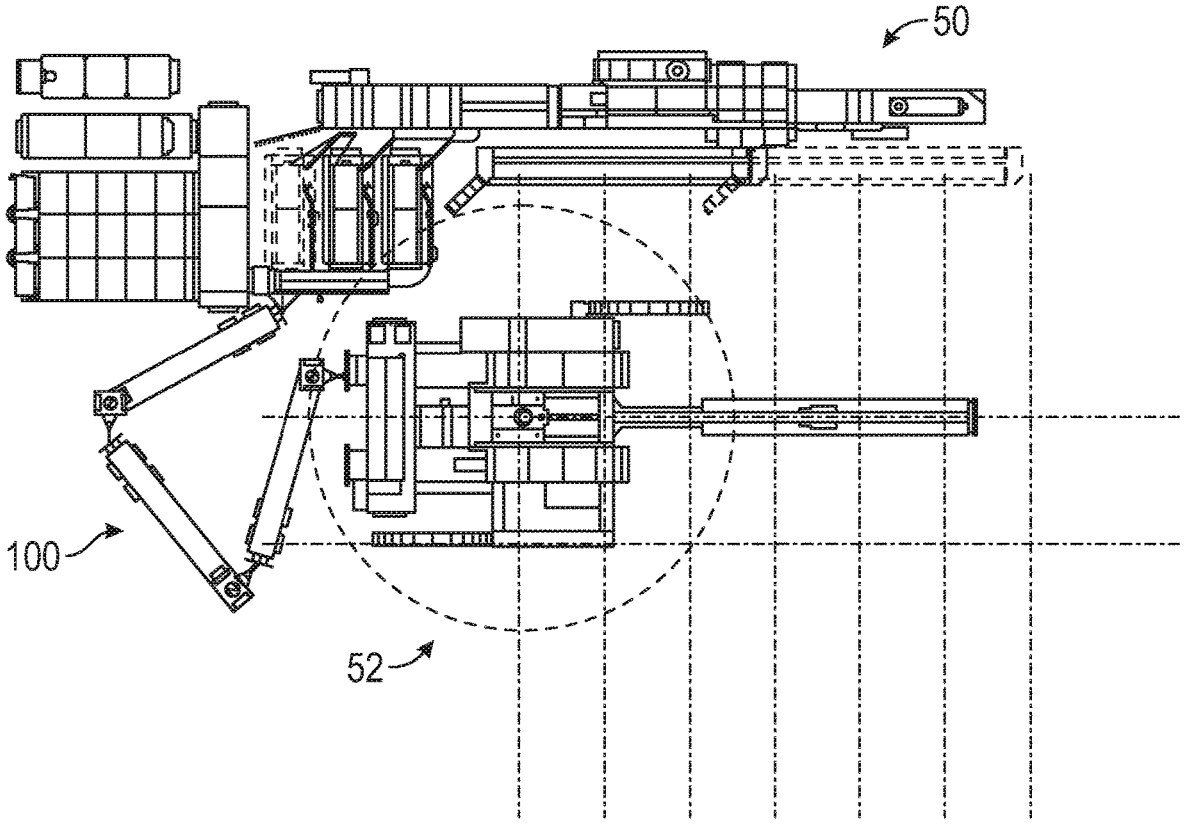
FIG. 34 is a plan view of a non-telescoping utility umbilical system extending between a utility system and a drill rig on a drilling pad, according to one or more embodiments.

It is noted that in FIGS. 1 and 20-32, a full series of 14 drill pads on the drill site were accommodated using two modules that are extendable. In contrast, and as shown in FIGS. 33 and 34, where non-extending modules are used, three modules are needed to accommodate the far reach to well pads 7 and 14, for example.

In one or more embodiments a method of operation 200 may include transporting a utility umbilical module to a drill site by attaching the module to a tractor, truck, or other over-the-road pulling vehicle. (202) The module may be transported via roadways from storage or from a drill site to the drill site in anticipation of drilling operations. One or more of the utility umbilical modules may be electrically and fluidly coupled between a utility plant at the drill site and the drill rig. (204) That is, plugs on the module may be plugged into power or communication systems at the utility plant and the rig or other adjacent modules may be plugged into the plug panel at a front of the module. In addition, hoses or other fluid supply lines may be connected to a rear end of the module to the utility plant and hoses or other fluid supply lines may be connected to the front end of the module from the rig or from an adjacent module. Depending on the size of the site, the module may be extended or used in its retracted state. (206) In some cases, the module may be used in its retracted state initially and then extended as the drill rig moves further from the connection to the utility plant. The extension process may include pulling the front of the module away from the rear portion of the module. The electrical systems and the low pressure fluid lines may extend as the module extends. When the module is extended, the second high-pressure line may be lowered to bring it into line with the primary line and the two may be fluidly coupled. Downriggers on the module may be deployed to support the module in the extended condition and may be retracted during movement. That is, the drill rig may move from pad to pad across a drill site and the umbilical system may track behind the drill rig and maintain electrical and fluid coupling with the utility plant during movement of the rig and during drilling operations. (208) At each drilling pad, the down riggers may be deployed to assist with support and stabilization of the modules. Upon completion of the drilling operations, the modules may be disconnected and retracted. (210) That is the second high-pressure drilling fluid line may be disconnected from the primary line and the sliding brackets may be used to lift the second line clear of the primary line. The module may be retracted and the telescoping portions of the low pressure fluid lines may plunge into the sleeves of their respective lines. The drag chain assembly may unfold rearwardly taking up slack in the electrical lines. The module may be coupled to a tractor, truck, or other over-the-road pulling vehicle (212) and the module may be transported to a new drilling site, to storage, or to another location (214).

Figure 35:
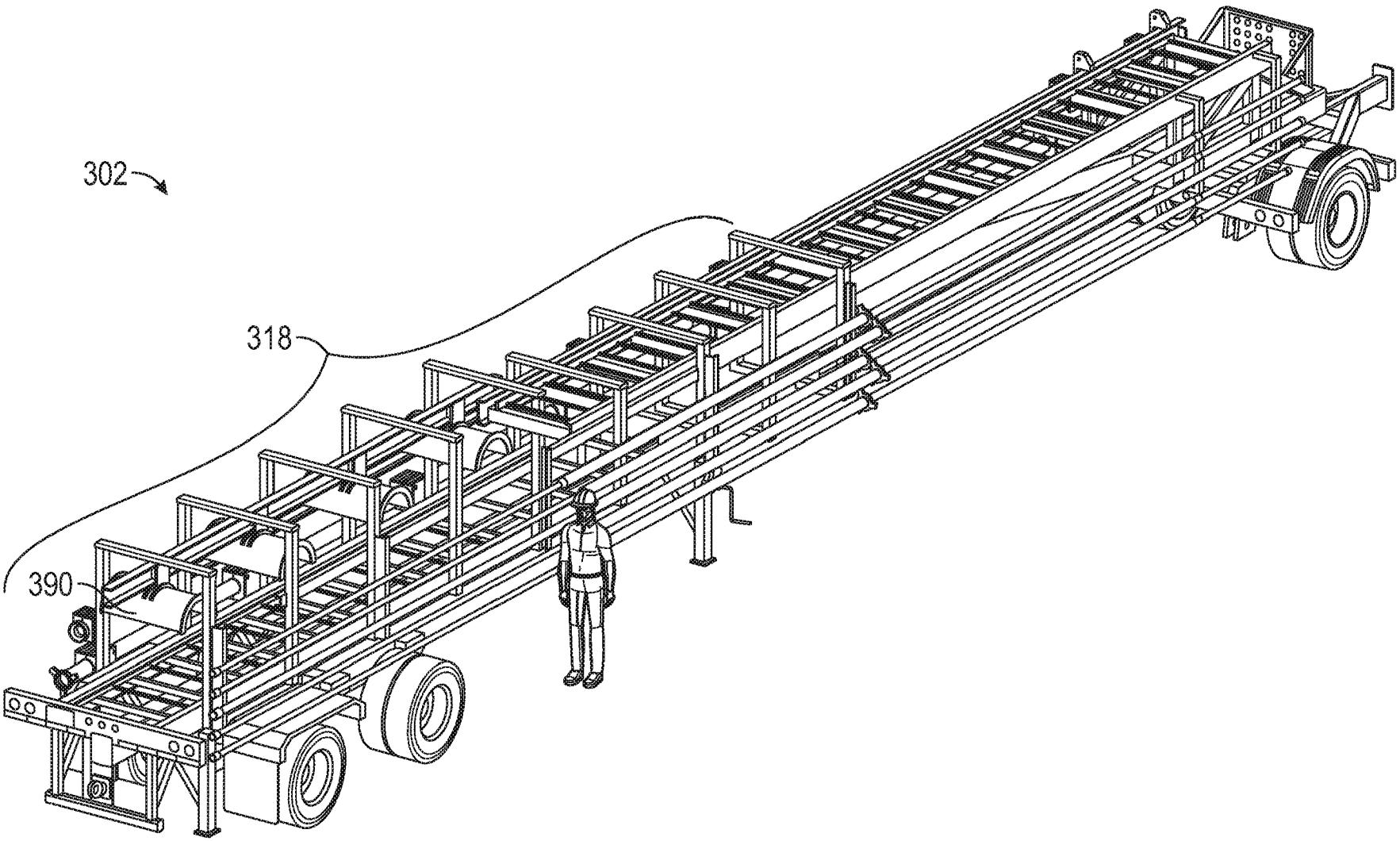
FIG. 35 is a perspective view of another embodiment of a utility umbilical module in an extended arrangement, according to one or more embodiments.
Figure 36:
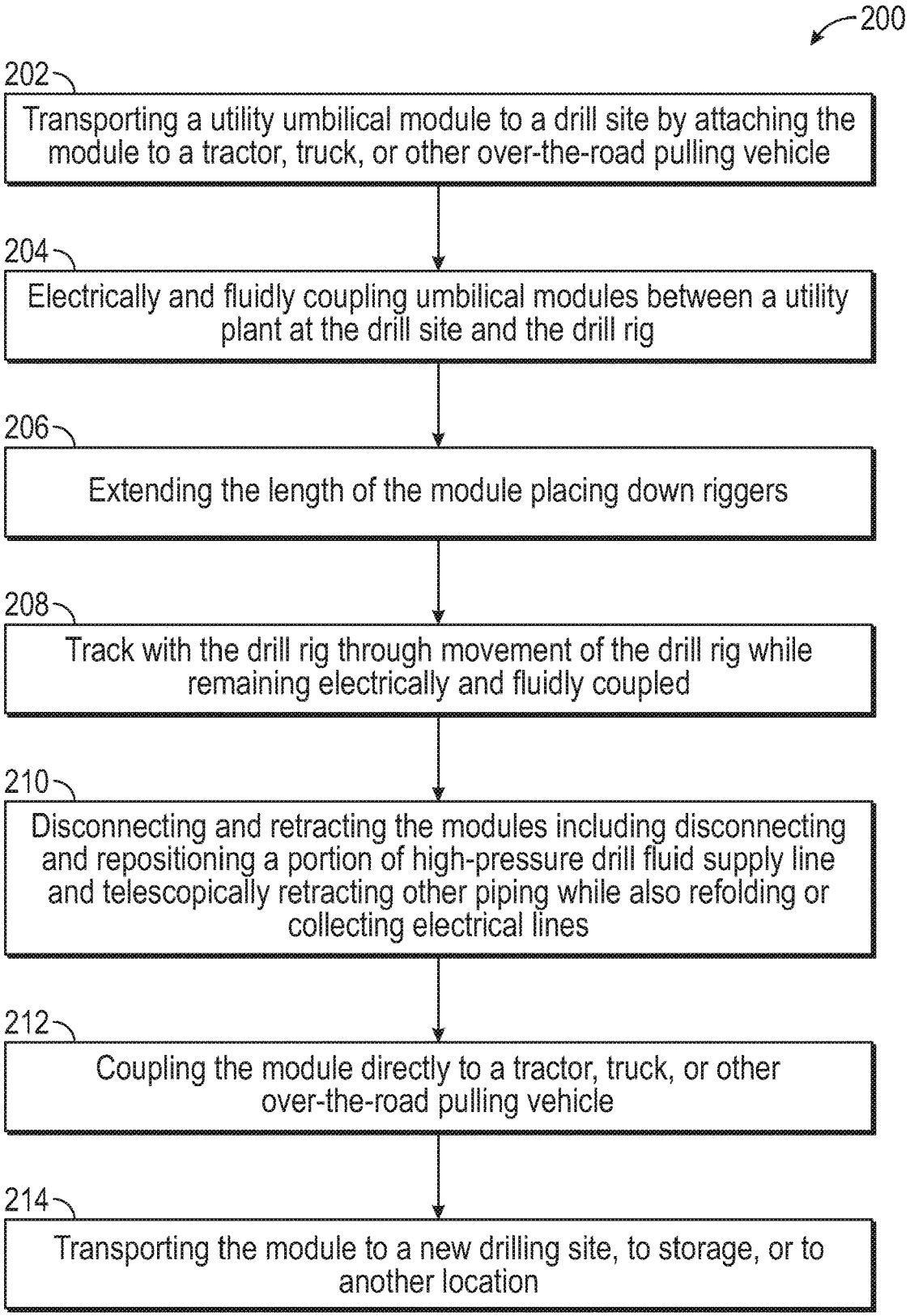
FIG. 36 is a block diagram of a method of using a utility umbilical system, according to one or more embodiments.

While a particular embodiment of a utility umbilical module has been shown, several alternatives features and systems may be provided. For example, a module 302 may include a festoon system to accommodate the extension and retraction of the lines in the electrical system. That is, as shown in FIG. 35, the rear cage portion 318 may be equipped with a series of festoon shelves 390 in lieu of a drag chain. The festoon shelves may be adapted to be pulled along a rail system by the upper deck as the upper deck is extended from the cage. Each shelf may be adapted to remain stationary until a length line forward of it is pulled to a substantially straight and only slightly draped condition after which the shelf may begin to move with the line. That is, a series of catches may be provided along the rail and secured to the upper deck to cause each festoon shelf to move at a suitable time based on the amount of line that is draped in front of it in the collapsed state. Similar catches may be provided for retraction to cause the lines to drape between the festoon shelves to take up the slack created by retracting the module.

Although a flowchart or block diagram may illustrate a method as comprising sequential steps or a process as having a particular order of operations, many of the steps or operations in the flowchart(s) or block diagram(s) illustrated herein can be performed in parallel or concurrently, and the flowchart(s) or block diagram(s) should be read in the context of the various embodiments of the present disclosure. In addition, the order of the method steps or process operations illustrated in a flowchart or block diagram may be rearranged for some embodiments. Similarly, a method or process illustrated in a flow chart or block diagram could have additional steps or operations not included therein or fewer steps or operations than those shown. Moreover, a method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A utility umbilical module, comprising:

an extendable frame;

a plurality of extendable fluid lines arranged on the extendable frame and configured for fluid coupling between a utility plant and a drill rig, the plurality of extendable fluid lines including a high pressure drill fluid line comprising a primary portion secured to the frame and a second high-pressure portion secured to the frame with sliding brackets;

an expandable and retractable electrical system configured for electrically coupling a utility plant to a drill rig; and a ground engaging portion configured for over-the-road transport of the module.

2. The utility umbilical module of claim 1, wherein the plurality of extendable fluid lines comprises a plurality of telescoping lines.

3. The utility umbilical module of claim 1, wherein the second high-pressure portion is configured for sliding into alignment with the primary portion when the frame of the module is expanded.

4. The utility umbilical module of claim 1, wherein the expandable and retractable electrical system comprises a drag chain.

5. The utility umbilical module of claim 1, wherein the ground engaging portion comprises front and rear wheel structures comprising rims and tires for highway travel.

6. The utility umbilical module of claim 5, wherein the ground engaging portion comprises a front wheel structure including a pivot frame and a hitch.

7. The utility umbilical module of claim 1, wherein the expandable frame comprises a telescoping spine portion.

8. The utility umbilical module of claim 7, wherein the expandable frame comprises a rear portion having a lower cable deck and a cage and a front portion having an upper deck.

9. The utility umbilical module of claim 8; wherein the upper deck is retractable into the cage of the rear portion.

10. The utility umbilical module of claim 9, wherein the cage includes a rail and a rear end of the upper deck is guided during extension and retraction along the rail.

11. The utility umbilical module of claim 10, wherein the rail provides support to the rear end of the upper deck.

12. A drill rig system, comprising:

a utility plant;

a mobile drill rig; and a utility umbilical system configured for placing the utility plant and the drill rig in electrical and fluid communication during drilling and throughout movement of the drill rig on a drilling site, the utility umbilical system, comprising:

a plurality of utility umbilical modules, each module comprising:

an expandable frame;

a plurality of extendable fluid lines arranged on the expandable frame and configured for fluid coupling between a utility plant and a drill rig, the plurality of extendable fluid lines including a high-pressure drill fluid line comprising a primary portion secured to the frame and a second high-pressure portion secured to the frame with sliding brackets;

an expandable and retractable electrical system configured for electrically coupling a utility plant to a drill rig; and a ground engaging portion configured for over-the-road transport of the module.

13. The drill rig system of claim 12, wherein the plurality of extendable fluid lines comprises a plurality of telescoping lines.

14. The drill rig system of claim 12, wherein the second high-pressure portion is configured for sliding into alignment with the primary portion when the frame of the module is expanded.

15. A utility umbilical module, comprising:

an extendable frame comprising a telescoping spine portion, a rear portion having a lower cable deck and a cage, and a front portion having an upper deck;

a plurality of extendable fluid lines arranged on the extendable frame and configured for fluid coupling between a utility plant and a drill rig;

an expandable and retractable electrical system configured for electrically coupling a utility plant to a drill rig; and a ground engaging portion configured for over-the-road transport of the module.

16. The utility umbilical module of claim 15, wherein the upper deck is retractable into the cage of the rear portion.

17. The utility umbilical module of claim 16, wherein the cage includes a rail and a rear end of the upper deck is guided during extension and retraction along the rail.

18. The utility umbilical module of claim 17, wherein the rail provides support to the rear end of the upper deck.

19. A drill rig system, comprising:

a utility plant;

a mobile drill rig; and a utility umbilical system configured for placing the utility plant and the drill rig in electrical and fluid communication during drilling and throughout movement of the drill rig on a drilling site, the utility umbilical system, comprising a plurality of utility umbilical modules, each module comprising the utility umbilical module of claim 15.

20. The drill rig system of claim 19, wherein the plurality of extendable fluid lines comprises a plurality of telescoping lines.

* * * * *